US009978207B2

(12) United States Patent
Sugai et al.

(10) Patent No.: US 9,978,207 B2
(45) Date of Patent: May 22, 2018

(54) GAME MACHINE, DICE GAME SYSTEM, AND STATION MACHINE

(71) Applicant: SEGA SAMMY CREATION INC., Tokyo (JP)

(72) Inventors: Taiji Sugai, Tokyo (JP); Takeshi Hisajima, Tokyo (JP); Takashi Hasegawa, Tokyo (JP)

(73) Assignee: SEGA SAMMY CREATION INC., Tokyo (JP)

( * ) Notice: Subject to any disclaimer, the term of this patent is extended or adjusted under 35 U.S.C. 154(b) by 4 days.

(21) Appl. No.: 15/036,971

(22) PCT Filed: Nov. 20, 2013

(86) PCT No.: PCT/JP2013/081242
§ 371 (c)(1),
(2) Date: May 16, 2016

(87) PCT Pub. No.: WO2015/075786
PCT Pub. Date: May 28, 2015

(65) Prior Publication Data
US 2016/0292954 A1 Oct. 6, 2016

(51) Int. Cl.
*G07F 17/32* (2006.01)

(52) U.S. Cl.
CPC ..... *G07F 17/323* (2013.01); *G07F 17/3211* (2013.01); *G07F 17/329* (2013.01); *G07F 17/3288* (2013.01)

(58) Field of Classification Search
CPC ..... G07F 17/3223
See application file for complete search history.

(56) References Cited

U.S. PATENT DOCUMENTS 4,856,787 A * 8/1989 Itkis ..... G07F 17/32 273/237
2002/0165028 A1 11/2002 Miyamoto et al.
(Continued)

FOREIGN PATENT DOCUMENTS

JP 2002-325963 A 11/2002
JP 2008-178599 A 8/2008
(Continued)

*Primary Examiner* — Omkar Deodhar
(74) *Attorney, Agent, or Firm* — Drinker Biddle & Reath LLP

(57) ABSTRACT

A game environment where an operation status of a player's own station machine can be easily monitored and operated and an operation status of other station machines can be also easily monitored. A game machine capable of executing a specified game by connecting a plurality of station machines to enable communications between them, wherein each station machine includes a display panel that displays an image indicating progress of the game including a player's own operation status; and wherein the station machine is configured to be capable of: generating a first display image including the player's own operation status; generating a second display image including the player's own operation status and an operation status of other station machines; and switching between a first display mode to display the first display image on the display panel and a second display mode to display the second display image on the display panel.

5 Claims, 21 Drawing Sheets

(56) References Cited

U.S. PATENT DOCUMENTS

| | | | | |
|---|---|---|---|---|
| 2002/0183105 | A1* | 12/2002 | Cannon | A63F 13/08 463/4 |
| 2008/0194310 | A1 | 8/2008 | Yoshizawa | |
| 2009/0203437 | A1 | 8/2009 | Yoshizawa | |
| 2009/0209322 | A1 | 8/2009 | Yoshizawa | |
| 2009/0275412 | A1* | 11/2009 | Green | G07F 17/32 463/42 |
| 2012/0208621 | A1 | 8/2012 | Kido | |

FOREIGN PATENT DOCUMENTS

| | | | |
|---|---|---|---|
| JP | 2009-189802 | A | 8/2009 |
| JP | 2009-189803 | A | 8/2009 |
| JP | 2012-165920 | A | 9/2012 |

* cited by examiner

GAME MACHINE, DICE GAME SYSTEM, AND STATION MACHINE

CROSS-REFERENCE TO RELATED APPLICATION

This application is the U.S. national phase of the International Patent Application No. PCT/JP2013/081242 filed Nov. 20, 2013, the entire content of which is incorporated herein by reference.

FIELD

The present disclosure relates to a game machine, a dice game system, and a display program which are used at casinos.

BACKGROUND

Games are played at casinos at various places in the world by dealers playing dice and trumps and operating lottery machines such as roulettes and by players predicting pips on dice, combinations of trumps, and winning pockets in roulettes, bidding, for example, chips on a betting board, and earning dividends according to the lottery results.

With the advances in electronics and communications technology in recent years, game machine systems in which computer devices serve in place of the dealers and perform the lottery operation conventionally performed by the dealers have been being marketed.

For example, Japanese Patent Application Laid-Open (Kokai) Publication No. 2009-189802, Japanese Patent Application Laid-Open (Kokai) Publication No. 2009-189803, and Japanese Patent Application Laid-Open (Kokai) Publication No. 2012-165920 disclose game devices configured so that they can play SICBO, which is a popular dice game at casinos in Asian locations such as Macao (PTL 1 to PTL 3). SICBO originally is a game in which a dealer throws three dice and a player predicts the total number of pips appearing on the dice and a combination of the pips, bets on patterns and numbers on a betting table (by betting chips or the like on the predicted content), and earns dividends according to the number of pips on the dice. The betting table is provided with, for example, an area for making bets by predicting the number of pips appearing on the dice (for example, a combination of two dice from among the three dice [Combination]), an area for making bets by predicting the total number on the dice (for example, the total number on the three dice [Total]), and further an area for making bets by predicting whether the total number of pips on the three dice is "Big" or "Small" (for example, "Big" (11 to 17) or "Small" (4 to 10) [Big or Small]). The dealer throws the three dice and the player makes a bet while the dealer covers the dice with a cover; and after the dealer declares betting closed (for example, by declaring "No more bet"), the dealer opens the cover and reveals the pips on each dice, thereby determining a win or loss.

The game devices described in PTL 1 and PTL 2 mentioned above are configured so that a plurality of stations 4 are placed at a housing 2 formed so as to surround a game unit 3, in which dice 7 are operated, and each of a plurality of players is seated at each station 4 and can play the SICBO game. Each station 4 is designed so that images of the betting board are displayed on an image display device 7 with a touch panel attached to its front face and the player can perform betting operations as in conventional cases by operating the touch panel (PTL 1: FIG. 2 and FIG. 6; and PTL 2: FIG. 2 and FIG. 6).

A game machine described in PTL 3 is designed so that the stations 4 are placed so as to surround a SICBO device 3 where dice 27 are operated; and each station 4 accepts bets as the player performs touch operations on a touch panel 56 attached to a front face of a display 8 (PTL 3: FIG. 1, FIG. 3, and FIG. 6).

Meanwhile, the above-mentioned PTL 1 to PTL 3 do not clearly describe whether to display a betting table on which the player's own betting status is reflected, or display a betting table on which the betting status of other stations is also included and reflected, on the display for each station.

When only the player's own betting status is displayed at each station, it is very obvious the betting amount the player themselves has bet on which betting position; however, that player cannot tell betting positions and betting amounts at other stations.

Since the amount of dividends at a specific betting position changes according to how much other stations are betting on that specific betting position, the player needs to know the betting status of other stations in order to predict the expected amount of dividends at the specific betting position.

On the other hand, when the betting status of all the stations including other stations is displayed, the betting status is displayed in the same manner as the conventional game in which a plurality of players make bets on one betting board at the same time, so that it is easy to comprehend the entire betting status, but it is difficult for the player to comprehend the betting amount the player themselves has bet on which betting position.

Particularly, with a system of a huge game machine in which lottery results of one lottery apparatus are shared by many stations, as the number of bets from each station becomes larger in the middle and last half of a betting period, it becomes impossible to comprehend the player's own betting status.

So, an object of the present disclosure is to provide a game environment where the operation status of the player's own station machine can be easily monitored and operated and the operation status of other station machines can be also easily monitored.

SUMMARY

A game machine according to an embodiment which solves the above-described problems is a game machine capable of executing a specified game by connecting a plurality of station machines to enable communications between them, each of the station machines including a display panel that displays an image indicating progress of the game including a player's own operation status; and the station machine being configured to: generate a first display image including the player's own operation status; generate a second display image including the player's own operation status and an operation status of other station machines; and switch between a first display mode to display the first display image on the display panel and a second display mode to display the second display image on the display panel.

A game machine according to an embodiment which solves the above-described problems is a game machine comprising: a plurality of station machines; and a master machine connected to the plurality of station machines to enable communications between them, each of the station machines comprising: a touch panel that accepts operation by a player; a display panel that displays an image indicating progress of a game including the player's own operation status corresponding to the operation over the touch panel; and a control unit that transmits the player's own operation status to the master machine and controls display on the display panel; the master machine integrating the operation status at each station machine to form an integrated operation status and transmitting the integrated operation status to each station machine; and the station machine being configured to: generate a first display image including the player's own operation status; generate a second display image including the player's own operation status and an operation status of other station machines by referring to the transmitted integrated operation status; and switch between a first display mode to display the first display image on the display panel and a second display mode to display a synthetic image, which is obtained by synthesizing the first display image with the second display image, on the display panel.

A dice game system according to an embodiment which solves the above-described problems is a dice game system comprising: a plurality of station machines; a master machine connected to the plurality of station machines to enable communications between them; and a dice lottery apparatus that performs lottery using dice, each of the station machines comprising: a touch panel that accepts operation by a player; a display panel that displays an image indicating progress of a game including the player's own operation status corresponding to the operation over the touch panel; a control unit that transmits the player's own operation status to the master machine and controls display on the display panel; and a display switching switch provided outside the touch panel; the master machine: integrating the operation status at each station machine to form integrated operation information and transmitting the integrated operation information to each station machine; and transmitting dividend information according to a result of the lottery at the dice lottery apparatus to each station machine; and wherein the control unit for the station machine: generates a first display image indicating, on a first betting board, a pip-count prediction status at the player's own station machine including the player's own operation status; generates a second display image indicating, on a second betting board, a pip-count prediction status of all the plurality of station machines by referring to the transmitted integrated operation information; displays the first display image in response to first operation of the display switching switch; displays a synthetic image which is obtained by synthesizing the first display image with the second display image in response to second operation of the display switching switch; and displays a dividend image corresponding to the pip-count prediction status of each station machine by referring to the transmitted dividend information.

A display program according to an embodiment which solves the above-described problems is a display program executed by a plurality of station machines in a game system capable of executing a specified game by connecting the plurality of station machines to enable communications between them, each of the station machines comprising: a touch panel that accepts operation by a player; a display panel that displays an image indicating progress of the game including the player's own operation status corresponding to the operation over the touch panel; and a control unit that controls display on the display panel; and the station machine being configured to enable the control unit execute: a function that accepts operation performed on the touch panel; a function that generates a first display image including the player's own operation status based on the operation performed on the touch panel; a function that generates a second display image including the player's own operation status and an operation status of other station machines; a function that displays the first display image on the display panel in response to first operation of a display switching switch; and a function that displays, on the display panel, an image obtained by synthesizing the first display image with the second display image in response to second operation of the display switching switch.

An embodiment may include the following configurations when desirable.

(1) In the second display mode, the station machine accepts operation performed on the touch panel in response to the first display image and/or operation performed on the touch panel in response to the second display image.

(2) The station machine is equipped with a display switching switch for switching between the first display mode and the second display mode outside the touch panel.

(3) The second display image comprises an additional image according to a total expected number of pips on the dice corresponding to areas constituting the second betting board.

An embodiment is configured so that it is possible to switch between the first display mode to display the first display image including the player's own operation status and the second display mode to display the synthetic image obtained by synthesizing the first display image with the second display image to display the second display image including the player's own operation status and the operation status of other station machines. Therefore, it is easy to monitor and operate the operation status of the player's own station machine and also monitor the operation status of other station machines.

DETAILED DESCRIPTION

Figure 1:
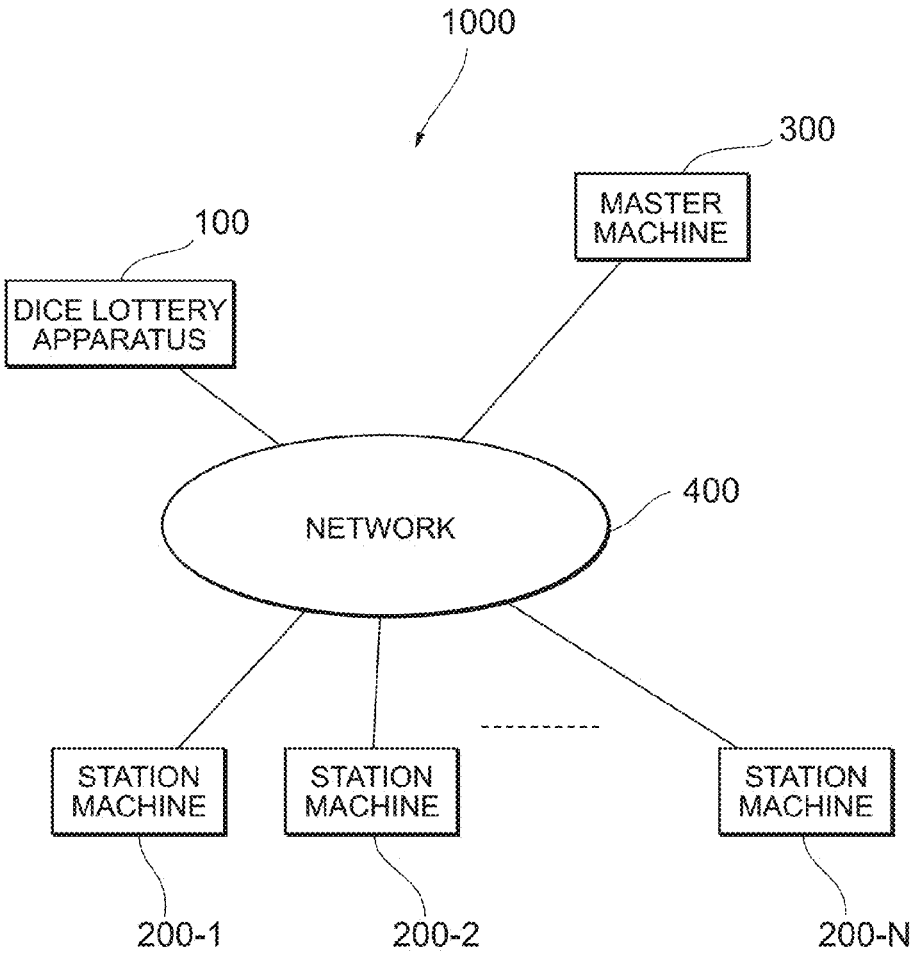
FIG. 1 is a schematic configuration diagram illustrating one embodiment of a dice game system according to an embodiment.

Embodiments will be explained below in detail. Incidentally, the following embodiments are just for illustration and are not intended to be limited to such embodiments. Moreover, embodiments can vary in different ways as long as such variations do not depart from the gist of the disclosure. Furthermore, a person skilled in the art can adopt an embodiment in which each element described below is replaced with its equivalent.

Furthermore, a positional relationship indicating, for example, whether the relevant position is above or below something or on the right or left side of something as indicated whenever necessary is based on illustrations of the drawings unless otherwise specified. Furthermore, various sizes and proportions in the drawings are not limited to the proportions indicated in the drawings. Also, in the interest of ease of comprehension, the following explanation will be given by taking an example of an embodiment implemented by using an information processing device for games; however, the scope is not limited to such embodiment as described above.

Definitions

Terms are defined as follows in this description.

"Chips": virtual coins used by players to declare their pip-count prediction. One "chip" has a certain amount of credits or points.

A "betting board": a virtual table where the chips are placed in order for the players to declare their pip-count prediction. The betting board is prepared according to the type of game.

"Bet/betting": to declare the player's pip-count prediction. Specifically speaking, "bet/betting" means to place the chips on the betting board.

A "betting position": a position at which to place the chips on the betting board. Different betting positions are set according to the types of games.

A "betting amount": a total number of credits or points of the chips placed at the same betting position. The betting amount means a subtotal of bets placed at the same betting position by the same player or a total number of bets placed at the same betting position by all the players.

A "betting status": an integrated operation status which is obtained by integrating the betting status of each player or each group of players and which indicates how much is being bet at which betting position on the betting board.

"Synthesis": to combine two display images and display them on one display panel. Synthesis comprises changing of the size, shape, or position of either one or both of the two display images so that both display images can be visually recognized. Moreover, synthesis comprises overlapping either one of the two display images over the other or displaying them in individual windows.

A. Configuration

An embodiment relates to a dice game system configured to be capable of executing SICBO.

A-1. Dice Game System

FIG. 1 is a schematic configuration diagram illustrating an embodiment of a dice game system. Referring to FIG. 1, a dice game system 1000 according to this embodiment comprises a dice lottery apparatus 100, respective station machines 200-N (hereinafter simply referred to as the "station machine 200" when it is unnecessary to specify each station machine), and a master machine 300. The dice lottery apparatus 100, the respective station machines 200-N, and the master machine 300 are connected via wire and/or wirelessly to each other via a network 400 such as a LAN (Local Area Network), a WAN (Wide Area Network), or the Internet so as to enable communications between them. The network 400 may be either a wireless LAN or a wired LAN, or a combination of the wireless LAN and the wired LAN; and a wireless LAN device or a wired LAN device may be mounted in each of the above-mentioned equipment units or may be connected as an external device like a LAN card.

The dice lottery apparatus 100 is a lottery means for performing dice lottery in accordance with SICBO game rules, using three dice. Each station machine 200-N is an operation display console at which each player is seated to execute betting processing according to the predicted number of pips on the dice. The master machine 300 is a server apparatus configured to be capable of controlling dice lottery at the dice lottery apparatus 100, receiving the betting status and other operation information of each station machine 200-N in a manner capable of updating the above-mentioned information, and delivering the integrated operation status obtained by integrating the above-mentioned information.

Incidentally, depending on the content of the game system, the game system can be configured by omitting the dice lottery apparatus 100 and/or the master machine 300 and connecting only the plurality of station machines 200 to each other.

A-2. Dice Lottery Apparatus

Figure 2:
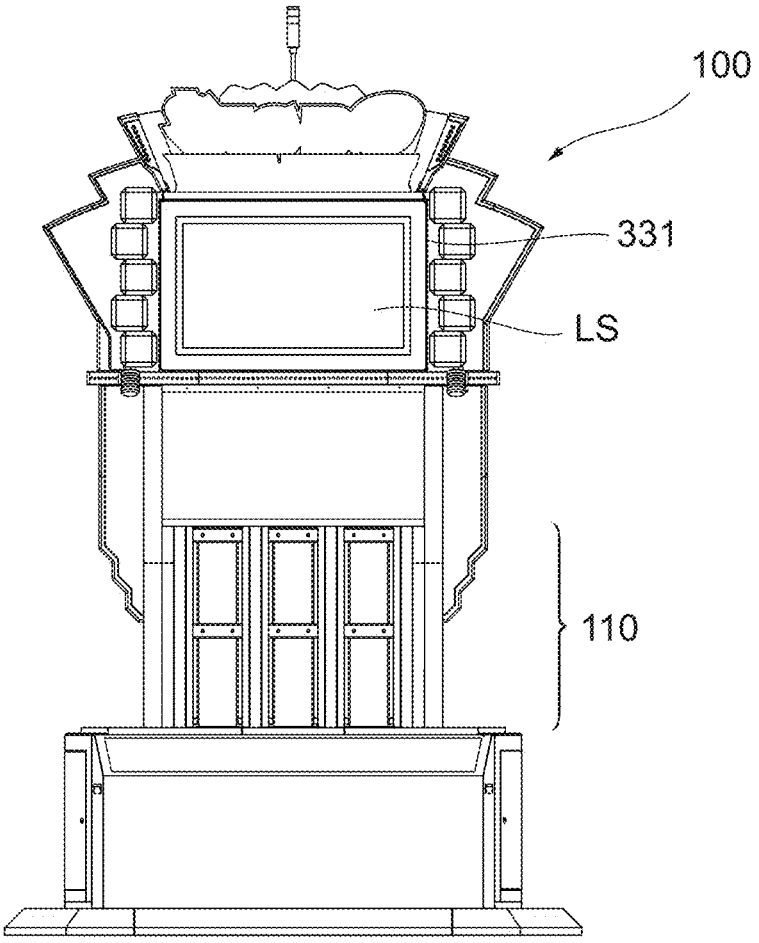
FIG. 2 is an external front view of a dice lottery apparatus according to the embodiment.
Figure 3:
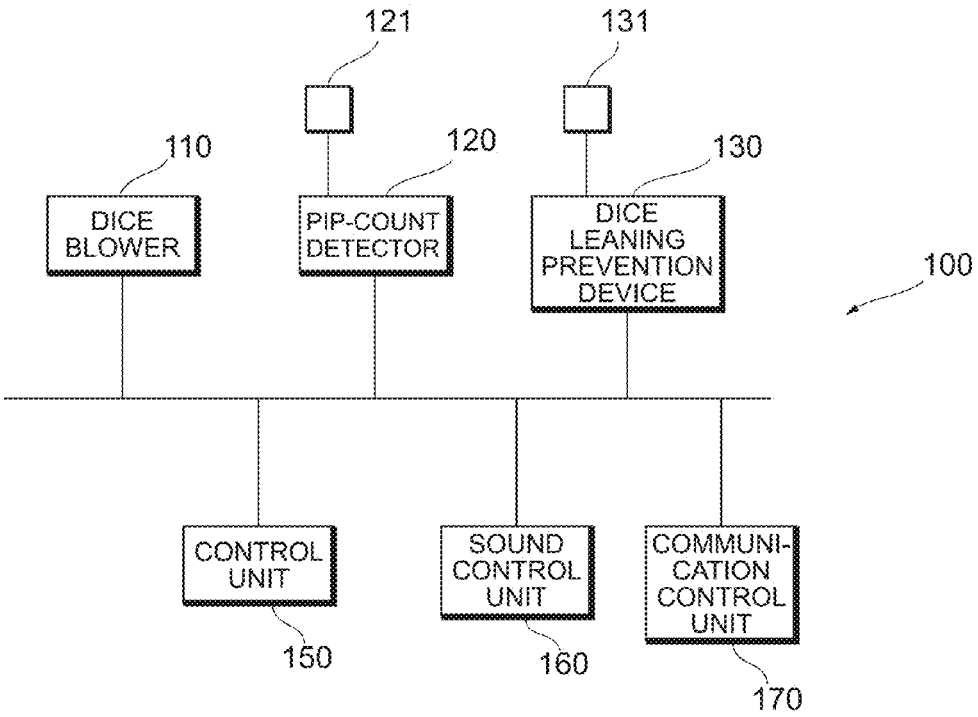
FIG. 3 is a system block diagram of the dice lottery apparatus according to the embodiment.

FIG. 2 illustrates an external front view of the dice lottery apparatus 100 and FIG. 3 illustrates a system block diagram of the dice lottery apparatus 100.

Referring to FIG. 2, the dice lottery apparatus 100 comprises, as its main structural elements, a dice blower 110 and a monitor 331 placed above the dice blower 110. The configuration of the dice blower 110 will be described later. The monitor 331 is a display means for receiving an image signal from a master display device 330 of the master machine 300 described later and displaying a live screen LS.

Referring to FIG. 3, the dice lottery apparatus 100 comprises, as mechanical functional blocks, the dice blower 110, a pip-count detector 120, and a dice leaning prevention device 130 and comprises, as electrical functional blocks, a control unit 150, a sound control unit 160, and a communication control unit 170.

Figure 4:
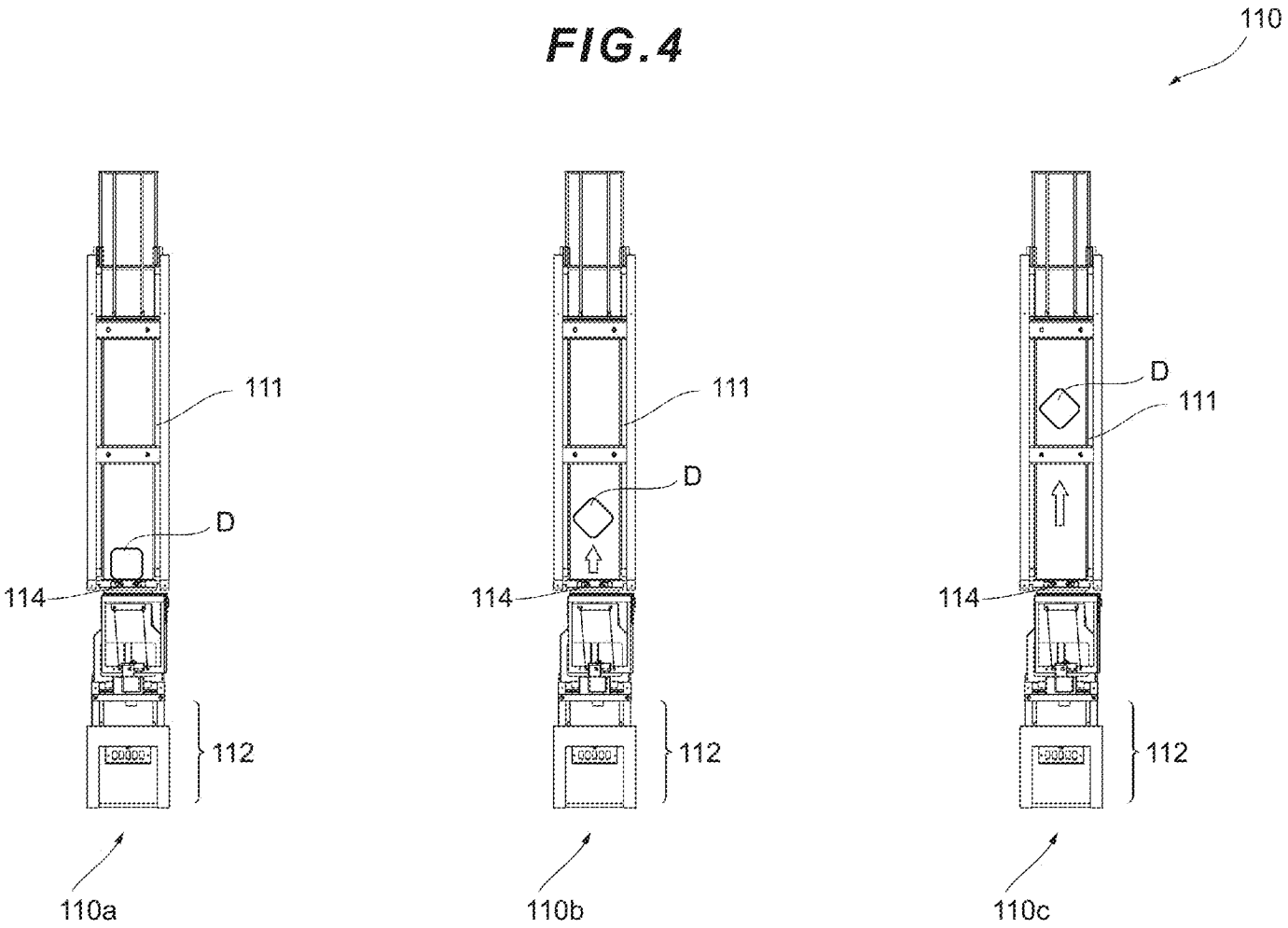
FIG. 4 is a diagram illustrating a schematic configuration of dice blowers according to the embodiment.

FIG. 4 is a diagram illustrating a schematic configuration of the dice blower 110. The dice blower 110 is constituted by three dice blowers 110*a* to 110*c* as illustrated in FIG. 4. Each dice blower 110*a* to 110*c* comprises a blowing mechanism 112, a dice table 114 mounted above the blowing mechanism 112, and a blowing pipe 111 mounted above the dice table 114.

The blowing pipe 111 is formed of a transparent material such as acryl and is designed so that an audience around each player can observe the process from operation to blow air upward to lift a dice D to operation to stop the dice. The dice D which is a light-weight, rounded dice formed of, for example, plastic is placed inside the blowing pipe 111 so that the dice D can be lifted with the air blown upward above the dice table 114.

The blowing mechanism 112 has an upward-blowing opening towards the dice table 114 and the blowing pipe 111. The blowing mechanism 112 comprises an air intake, a shutter for opening or closing the air intake, and fans for introducing air through the air intake (although they are not shown in the drawing); and the blowing mechanism 12 can send the air towards the dice D placed on the dice table 114, blow air upward to lift the dice D, and rotate the dice D in a blown-and-lifted state inside the blowing pipe 111. When the air sent by the blowing mechanism 112 stops, the dice D which has lost the drifting air flow falls down to the dice table 114, repeatedly bounces on the dice table 114 because of its own elasticity, and then gradually stops moving.

Referring back to FIG. 3, the pip-count detector 120 comprises an image sensor 121 such as an infrared camera or a CCD (Charge Coupled Device) sensor. When the movement of the dice D lifted with the air blown by the blowing mechanism 112 stops and the number of pips on the dice is determined, the pip-count detector 120 captures an image of the number of pips on the dice placed on the dice table 114 and transmits the captured image data of the dice D (hereinafter referred to as the "dice image data") to the master machine 300.

The dice leaning prevention device 130 comprises a vibrating device 131 which is a combination of a stepping motor or the like and a pulley and is configured so that it can shake the dice table 114. The dice leaning prevention device 130 prevents the fallen dice D from leaning against an inside wall of the blowing pipe 111 and making it difficult to identify the number of pips on the dice.

The control unit 150 is a computer device composed of, for example, a CPU, a ROM, and a RAM and is designed to: control the dice blower 110 in accordance with a dice tossing instruction, a lottery start instruction (lottery instruction), and so on transmitted from the master machine 300 via the network 400 to perform, for example, dice lottery; and control the pip-count detector 120 to transmit the dice image data to the master machine 300 once the number of pips on the dice is determined. The sound control unit 160 is configured so that it can output sounds to boost the progress of a game in synchronization with, for example, tossing of the dice. The communication control unit 170 is a communication device to perform data communications between the master machine 300 and the dice lottery apparatus 100.

Figure 5:
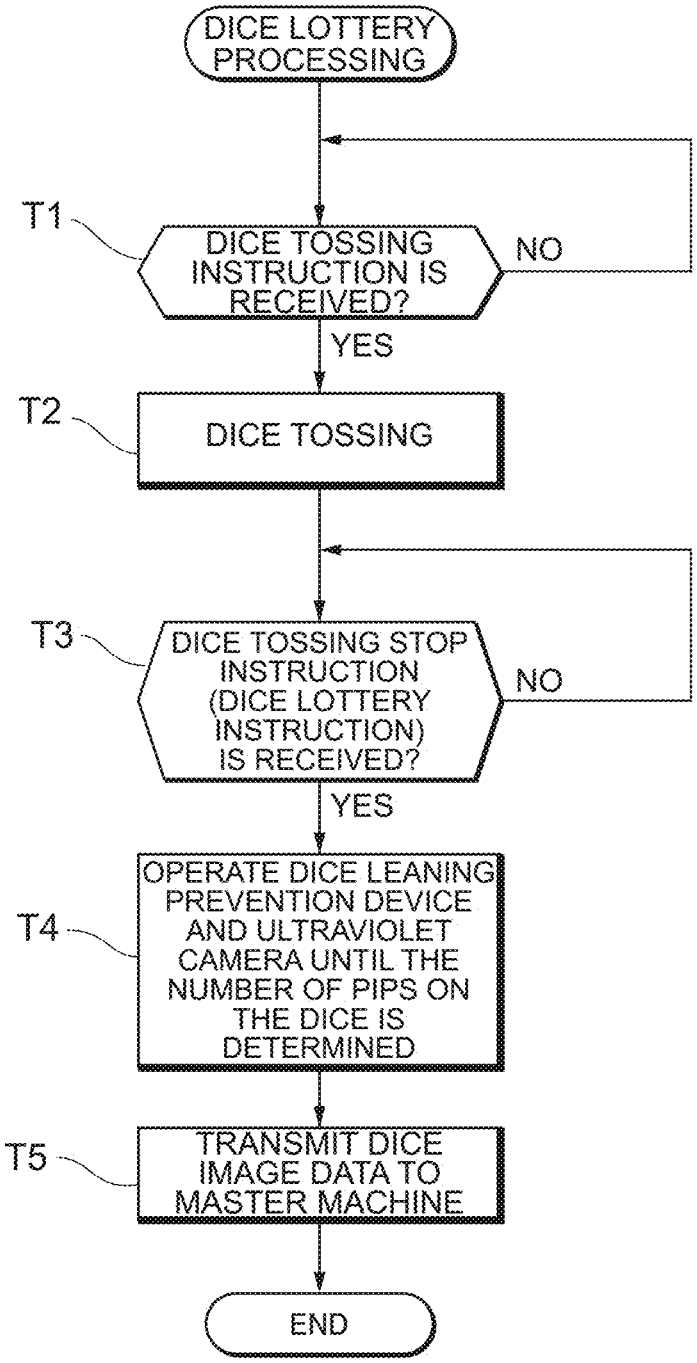
FIG. 5 is a flowchart illustrating dice lottery processing according to the embodiment.

FIG. 5 shows a flowchart illustrating dice lottery processing executed by the dice lottery apparatus 100. Referring to FIG. 5, when the control unit 150 for the dice lottery apparatus 100 receives an instruction to toss the dice D from the master machine 300 via the network 400 (step T1: YES), it starts the operation of the dice blower 110 to blow air upward to lift the dice D in order to toss the dice D (step T2). The dice blower 110 controls the blowing mechanism 112, opens the shutter of the air intake, activates the fans, and starts sending the air towards the dice D which stays still on the dice table 114. The dice D which has received the air flow rotates and is lifted with the air blown upward by a levitation force inside the blowing pipe 111. When the dice D rises to a certain height within the blowing pipe 111, the levitation force from the air flow which causes upward-blowing balances with the gravity force acting on the dice D and the dice D keeps floating at almost the same height. Next, when the control unit 150 for the dice lottery apparatus 100 receives a dice lottery instruction (that is, the dice D tossing stop instruction) from the master machine 300 via the network 400 (step T3: YES), the control unit 150 stops the upward-blowing operation by the dice blower 110 in order to make the dice D fall down and determine the number of pips on the dice. The dice blower 110 closes the shutter and shuts off the power of the fans in order to block the air flowing into the fans. As a result, the air flow inside the blowing pipe 111 is completely blocked and the floating dice D immediately falls down towards the dice table 114 within the blowing pipe 111. When this happens, the control unit 150 for the dice lottery apparatus 100 controls the dice leaning prevention device 130 to prevent the dice D from entering a state of leaning against the inside surface of the blowing pipe 111 (step T4). The dice leaning prevention device 130 controls the vibrating device 131 to slightly vibrate the dice table 114 on which the dice D is placed. Accordingly, the dice D becomes static in a horizontal state on the dice table 114 without leaning against the inside surface of the blowing pipe 111 and the number of pips on the dice D is determined.

Moreover, the control unit 150 controls the pip-count detector 120 to have the image sensor 121 start capturing images of the number of pips on the dice D. The dice image data captured by the pip-count detector 120 are transmitted sequentially from the communication control unit (communication control unit) 170 for the dice lottery apparatus 100 to the master machine 300 via the network 400 (step T5).

A-3. Master Machine

Figure 6:
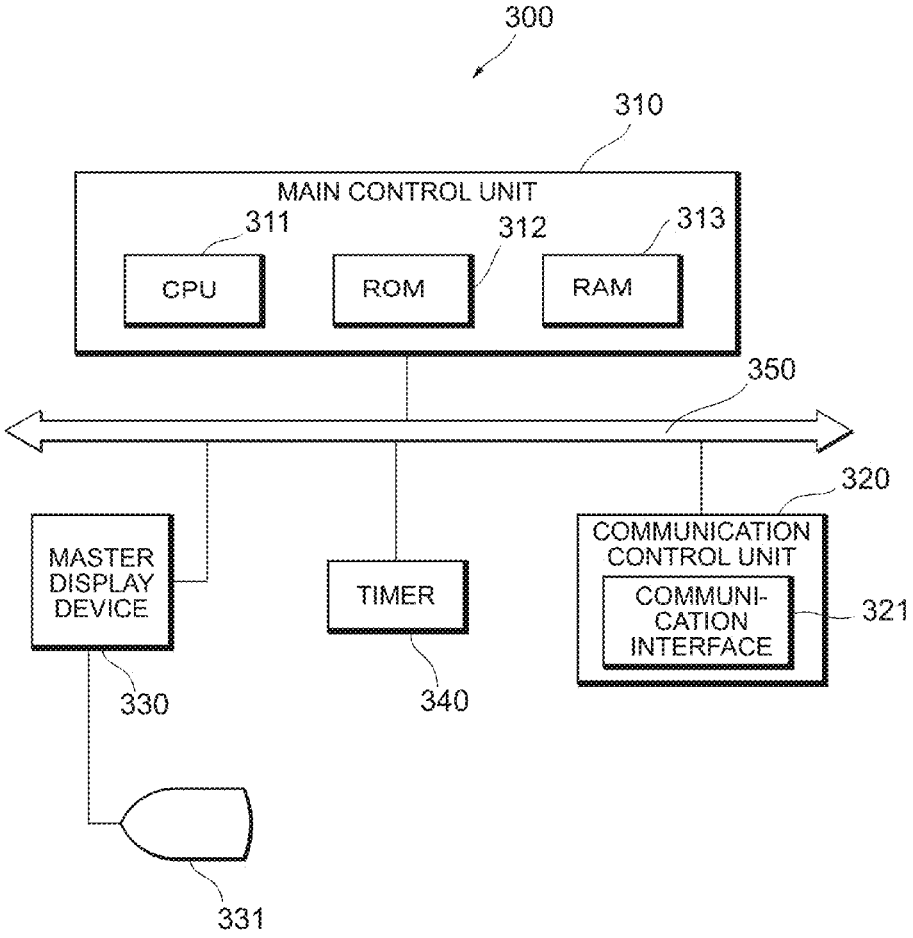
FIG. 6 is a system block diagram of a master machine according to the embodiment.

FIG. 6 illustrates a system block diagram of the master machine 300. Referring to FIG. 6, the master machine 300 comprises a main control unit 310, a communication control unit 320, a master display device 330, and a timer 340.

The main control unit 310 serves a function centrally controlling the master machine 300 and comprises, for example, a CPU 311, a ROM 312, and a RAM 313. The main control unit 310 is connected, via a bus 350, to the communication control unit 320, the master display device 330, the timer 340, and so on.

The ROM 312 records an IPL (Initial Program Loader) to be executed at first when executing game processing. Moreover, the ROM 312 records, for example, an operating system program that is required to control the operation of the entire master machine 300.

The RAM 313 is a temporary storage device equipped with a sufficient memory space for the CPU 311 to execute software programs and temporarily store other data. The RAM 313 stores programs which have been read for the master machine, necessary data for communications between the respective stations 200 and for communications with the dice lottery apparatus 100, the dice image data received from the dice lottery apparatus 100, and dice-pip-count information obtained by analyzing the dice image data.

The CPU 311 executes the IPL stored in the ROM 312 when the power is turned on or reset. Next, the CPU 311 transfers a control program for the master machine and a control program for the dice game, which are recorded in a disk or memory device put in, or connected to, a slot drive not shown in the drawing, to the RAM 313. Next, the CPU 311 executes the control program transferred to the RAM 313 and makes the entire machine function as the master machine 300 for the dice game.

The communication control unit 320 is a communication means for connecting the master machine 300 to the network 400. The communication control unit 320 comprises a communication interface 321, such as an analogue modem, an ISDN modem, an ADSL modem, or a cable modem for connecting to, for example, the Internet by using cable television lines, which complies with various standards used to construct, for example, a LAN. The communication interface 321 transmits/receives data to/from each station machine 200 and the dice lottery apparatus 100 under the control of the main control unit 310.

Because of the above-described configuration, the main control unit 310 receives a betting status (operation status) from each station machine 200 and generates integrated operation information in which an integrated operation status is reflected by integrating the betting status of all the station machines 200. Then, the integrated operation information is transmitted to each station machine 200 at appropriate timing.

Furthermore, the main control unit 310 generates an image (live screen LS) in which the betting status (the integrated operation status) of all the players is reflected in an image on a betting board, on the basis of the integrated operation information. The live screen LS is an image similar to the real betting board and corresponds to a "second display image" according to an embodiment. The live screen LS is displayed on the monitor 331 by the master display device 330.

Figure 7:
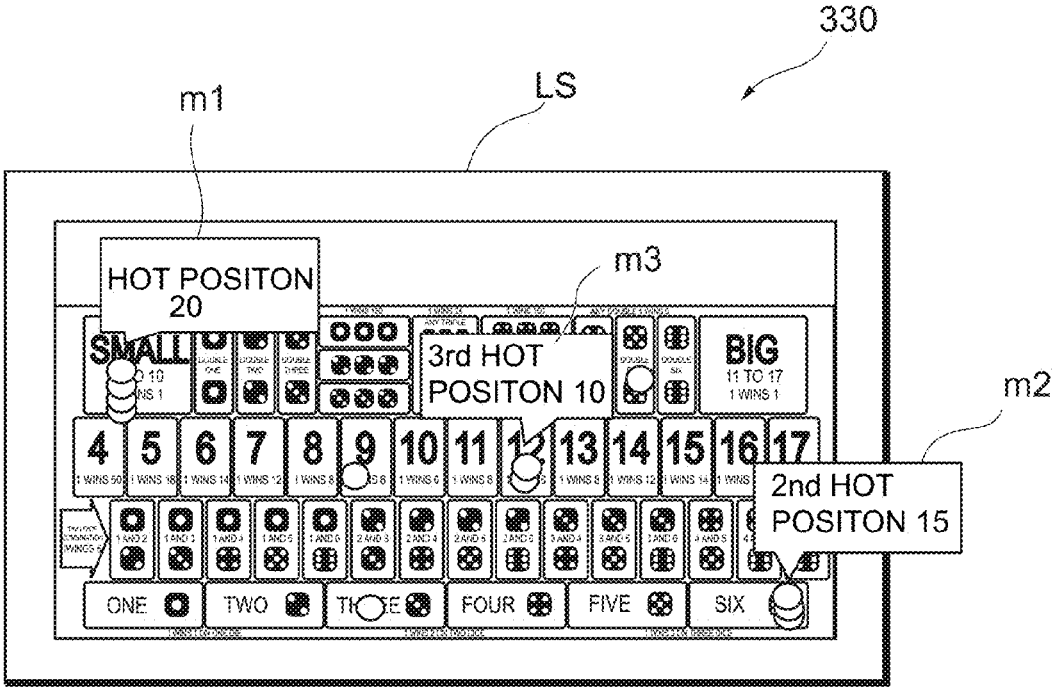
FIG. 7 is a diagram illustrating an example of a display image of a live screen according to the embodiment.

FIG. 7 illustrates an image display example of the live screen LS. Referring to FIG. 7, the betting board is displayed on the background, on which chips reflecting the betting status of all the players are displayed. When only one chip is placed at one betting position, it means that one chip is bet at that betting position. When a plurality of chips are placed at one betting position, it means that the plurality of chips are bet at that betting position. The main control unit 310 calculates a total amount of chips bet at each betting position. Then, the main control unit 310 determines the order according to the total amount of chips and adds a specified display according to the order rank. For example, referring to FIG. 7, hot position display messages m1 to m3 are displayed as additional images at first to M-th ranked (M=3 in this embodiment) betting positions. At the betting position where the largest betting amount is bet at that point in time, the hot position display message ("HOT POSITION" in FIG. 7) m1 and a total betting amount ("20" in FIG. 7) are displayed.

Similarly, at the betting position where the second largest betting amount is bet, the hot position display message ("$2^{nd}$ HOT POSITION" in FIG. 7) m2 and the total betting amount ("15" in FIG. 7) are displayed. At the betting position where the third largest betting amount is bet, the hot position display message ("$3^{rd}$ HOT POSITION" in FIG. 7) m3 and the total betting amount ("10" in FIG. 7) are displayed.

Incidentally, in this embodiment, the betting positions with the first to third ranked total betting amounts are objects to display the hot position display messages; however, the settings for, for example, for how many ranks the hot position display messages should be displayed can be changed as appropriate according to, for example, the design of the master machine 300.

Furthermore, the live screen may be configured to display how many players are betting on each betting position in a display mode in which such information can be easily visually comprehended. Possible examples of such display mode include a method of using different colors for the chips to display them and a method of displaying the number of players who have bet on each betting position at each betting position or in a peripheral area. In the method of using different colors for the chips, different colors are assigned to each player in the same manner as in a real dice game and the chips with the colors assigned to the respective players who have made bets are displayed at each betting position.

When one player bets a plurality of chips, chips overlaid one on top of another three-dimensionally are displayed like real chips being piled. When a plurality of players have bet on one betting position, the chips are displayed so that they are not overlaid one on top of another. On the other hand, by the method of displaying the number of players in the peripheral area, the total number of players who have bet on each betting position is displayed separately from the display of the chips, for example, by text-displaying the total number of players in a word balloon inserted and linked to the betting position. If the word balloon display is used, the betting position will not be covered with the text display of the number of players and the betting status and the number of players at each betting position will be easily visually recognized. Incidentally, in addition to the total number of players, the total betting amount bet on that betting position may be displayed. A hot position display message like the one explained with reference to FIG. 7 may be displayed to display the total betting amount. For example, regarding a betting position whose total betting amount is ranked high, a message indicating that the total betting amount is ranked high may be indicated besides the total betting amount.

Update frequency of the live screen LS can be set as appropriate according to update frequency of the betting status transmitted from each station machine 200 to the master machine 300 and can be set, for example, every second. Furthermore, as described later, the integrated operation information is transmitted from the master machine 300 to each station machine 200 at appropriate timing and each station machine 200 is configured to display the image (the second display image) which is similar to the live screen LS and in which the integrated operation status is reflected on the basis of the integrated operation information. Each player can instantly comprehend the amount of chips being bet on which betting position, by visually recognizing the live screen LS displayed on the master display device 330 or the second display image displayed on each station machine 200. Then, on the basis of this result, the player can change the betting position on which the player themselves has bet, or cancel the bet itself.

Furthermore, there is no limitation on an installment position of the master machine 300 as long as the master machine 300 can communicate with each station machine 200 and the dice lottery apparatus 100; however, the master machine 300 should preferably be installed at the dice lottery apparatus 100. Since the dice lottery apparatus 100 visually symbolizes a dice game system 1000, there is a high possibility that the master machine 300 may be placed at the center of the system where it can be visually recognized from any station machine 200. If the master machine 300 is installed around the dice lottery apparatus 100, it is easy to lay the network 400 to each station machine 200. Moreover, a communication connection with the dice lottery apparatus 100 can be simplified and a connection with the live screen LS is easy because of a short distance.

A-4. Station Machine

Figure 8:
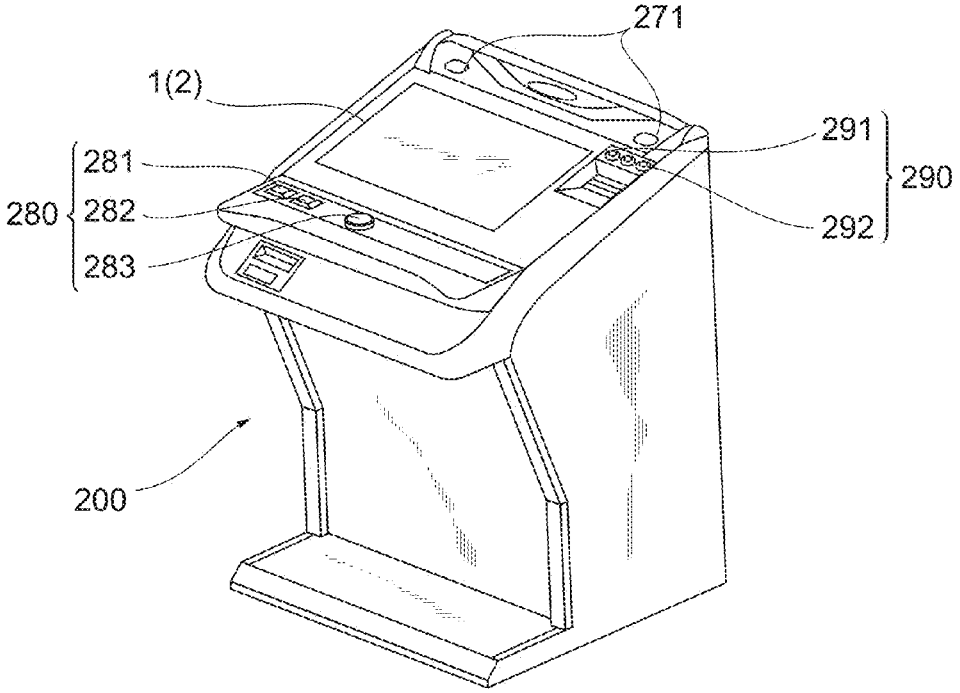
FIG. 8 is a perspective view for explaining an external configuration of the station machine according to the embodiment.

FIG. 8 illustrates a perspective view for explaining an external configuration of the station machine 200. Referring to FIG. 8, the station machine 200 has a platform structure equipped with, on its front board, a display panel 2 with a touch panel 1 on its front face, and various operation buttons and is configured so that the player can be seated and operate the station machine 200. Speakers 271 are located behind the touch panel 1 (the display panel 2). An operation button group 280 is located in front of the touch panel 1 (the display panel 2) and a setting key group 290 is located beside the touch panel 1 (the display panel 2).

The operation button group 280 comprises a call button 281, a pay-out button 282, and a display switching button 283. The call button 281 is an operation button to call a clerk when any problem or the like occurs. The pay-out button 282 is an operation button to demand payment of tickets according to the credits. The display switching button 283 is a switch to switch a betting board display mode to be displayed on the display panel 2 according to the present disclosure between a first display mode and a second display mode.

The details will be explained later.

The setting key group 290 comprises an audit key 291 and a reset key 292. The audit key 291 is a key hole for trial operation of the station machine 200. The reset key 292 is a key hole operated by the clerk when paying out the tickets or the like. These keys can be set and operated only by persons having specified authorities (for example, an operator or clerks of the dice game).

Figure 9:
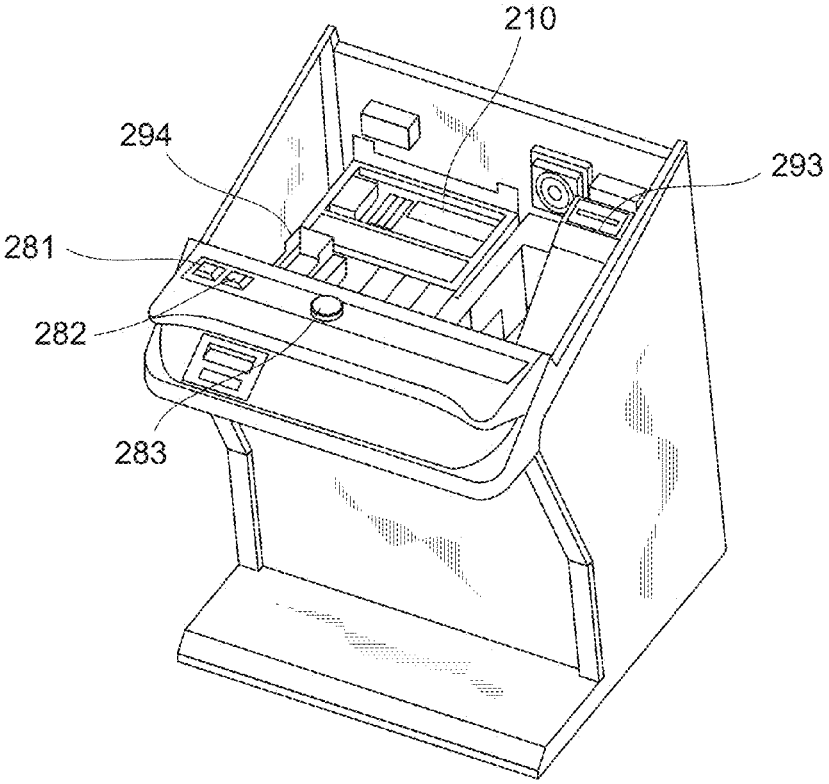
FIG. 9 is a perspective view for explaining an internal configuration of a station machine according to the embodiment.

FIG. 9 is a perspective view for explaining an internal configuration of the station machine 200. FIG. 9 illustrates the internal configuration when the front board is removed. Referring to FIG. 9, a station control unit 210, a bill identification machine 293, and a printer 294 are placed inside the station machine 200.

For example, when the player participates in the dice game, the bill identification machine 293 is a device for identifying, for example, the types and denominations of bills inserted through a cash insertion port. The printer 294 is a device for printing tickets to be paid out after, for example, the termination of the game.

Figure 10:
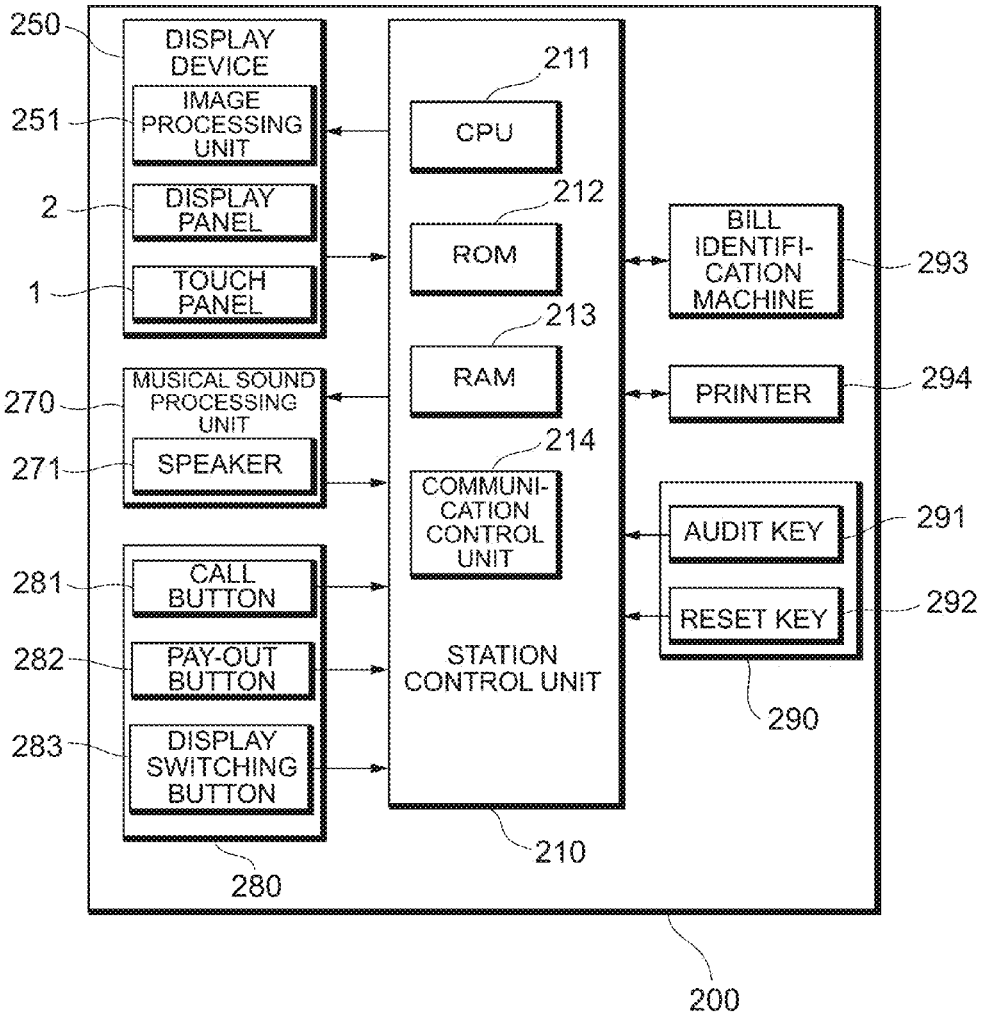
FIG. 10 is a system block diagram of the station machine according to the embodiment.

FIG. 10 illustrates a system block diagram of the station machine 200.

Referring to FIG. 10, the station machine 200 functionally comprises a station control unit 210, a display device 250, and a musical sound processing unit 270.

The display device 250 comprises the touch panel 1, the display panel 2, and an image processing unit 251. The touch panel 1 is a position detector configured to be capable of detecting a touch position of fingers or the like and outputting a positional signal corresponding to the touch position. There is no limitation to a position detection method of the touch panel 1 and various known techniques can be adopted as appropriate as long as they are suited for detection of the betting operation on the betting board. For example, it is possible to use position detection methods such as a resistive film method, a surface elastic wave method, an electromagnetic induction method, and an electrostatic capacity method.

The display panel 2 is a display device to display images, such as the betting board, which are required by the player to play the dice game. There is no limitation on display techniques of the display panel 2 and techniques such as liquid crystal display, organic EL display, plasma display, electrophoresis display, and CRT display can be applied as appropriate. The image processing unit 251 comprises a display processor and a frame memory, which are not shown in the drawing, and displays images on the display panel 2 on the basis of image data supplied from the station control unit 210. Specifically speaking, the display processor for the image processing unit 251 executes processing of the image data according to an image control program and then records the processed image data in the frame memory. The image data recorded in this frame memory is converted into a video signal at specified synchronization timing and output to the display panel 2.

The musical sound processing unit 270 retains specified sound source data and is configured to generate an acoustic signal for producing musical sounds corresponding to a musical sound output command from the station control unit 210 and output the musical sounds to the speaker 271. The musical sounds include BGM for the dice game and sound-synthesized instructions and guide messages.

The station control unit 210 comprises, for example, a CPU 211, a ROM 212, a RAM 213, and a communication control unit 214. The ROM 212 is a storage area for storing the IPL and also storing a control program of the station machine 200 comprising a display program according to an embodiment. The RAM 213 provides a temporary storage area, which is necessary when the CPU 211 executes the display program and the control program, and is an area for storing data relating to the betting status at the player's own station machine 200 and data which is transmitted from the master machine 300 and relates to the betting status (the integrated operation status) at other station machines 200. The communication control unit 214 is a communication means for connecting the station machines 200 to the network 400 and comprises a communication interface, such as an analogue modem, an ISDN modem, an ADSL modem, or a cable modem for connecting to, for example, the Internet by using cable television lines, which complies with various standards used to construct, for example, a LAN. The communication control unit 214 transmits/receives data to/from the master machine 300 under the control of the station control unit 210.

The CPU 211 executes the IPL stored in the ROM 212 when the power is turned on or reset. Next, the CPU 211 transfers the control program for the station machines and the display program according to an embodiment, which are recorded in the ROM 212, to the RAM 213. Next, the CPU 211 executes the control program and the display program, which have been transferred to the RAM 212, and makes the relevant station machine 200 function as the station machine according to an embodiment.

As the CPU 211 executes the control program, the station control unit 210 illustratively executes the following processing.

(1) The station control unit 210 receives data transmitted from the master machine 300 via the communication control unit 214 and stores it in a specified area in the RAM 213.

(2) When the data transmitted from the master machine 300 is a betting processing directive command, the station control unit 210 sets the status to a betting processing mode; and when the data transmitted from the master machine 300 is a lottery result display directive command, the station control unit 210 sets the status to a lottery result display mode.

(3) The station control unit 210 displays a corresponding image on the display panel 2 depending on whether the status is the betting processing mode or the lottery result display mode.

(4) The station control unit 210 calculates the number of dividend credits of the player's own station machine 200 on the basis of the lottery result, adds the calculated number of dividend credits to the player's own number of credits, and displays an image corresponding to the number of dividend credits on the display panel 2.

(5) When bills are inserted into the bill identification machine 293 and the bill identification machine 293 determines that they are legitimate bills, the station control unit 210 adds the number of credits according to the inserted amount of money and displays an image corresponding to the number of credits relating to the inserted money on the display panel 2.

(6) The station control unit 210 detects a position on the touch panel 1 touched by the player by referring to a positional signal output from the touch panel 1 in synchronization with input scanning timing (input of the positional signal will be hereinafter sometimes referred to as the "touch operation").

(7) The station control unit 210 judges whether the "touch operation" is correctly input or not; and if it is correctly input, the station control unit 210 refers to map data which defines the position in an image currently displayed on the display panel 2, and specifies operation content corresponding to the position on which the "touch operation" was performed. For example, in a case of operation to move a specified chip(s) (hereinafter sometimes referred to as the "movement operation"), the station control unit 210 displays an image to display the chip(s) at a newly detected position, on the display panel 2.

(8) When the station control unit 210 detects that "continuous operation" which had been detected until the last input scanning timing is no longer detected at the latest input scanning timing, the station control unit 210 refers to the map data associated with the betting board and specifies a "betting position" on which the player has bet chips.

(9) When the station control unit 210 specifies that the chips have been newly bet, the station control unit 210 transmits the betting status to specify the new "betting position" as a new pip-count prediction status of the relevant station machine 200 to the master machine 300 via the communication control unit 214.

Particularly, as the CPU executes the display program according to an embodiment, the station control unit 210 illustratively executes the following processing as functions according to an embodiment.

(10) When the status is the betting processing mode, the station control unit 210 refers to the integrated operation information transmitted from the master machine 300 and updates the integrated operation information stored in the RAM 213.

(11) When the status is the betting processing mode and the operation status of the display switching button 283 is a first operation state (for example, a state of not being pressed), the station control unit 210 has the image processing unit 251 generate image data of an image to be displayed in a normal betting processing mode (a first display image) including the player's own betting board (a first betting board) and displays the image on the display panel 2 (hereinafter referred to as the "first display mode").

(12) When the status is the betting processing mode and the operation status of the display switching button 283 is a second operation state (for example, a state of being pressed), the station control unit 210 has the image processing unit 251 execute the following processing (hereinafter referred to as the "second display mode").

(a) The image processing unit 251 refers to the integrated operation information stored in the RAM 213 so that it can be updated.

(b) The image processing unit 251 generates a live screen image (a second display image) indicating the pip-count prediction status of the entire system, including the player's own station machine 200 and other station machines 200, on a betting board different from the first betting board (a second betting board).

(c) The image processing unit 251 counts a betting amount (an expected value of the number of pips on the dice) at each betting position, generates an additional image according to the total expected number of pips on the dice, and adds the additional image to the second display image. For example, the image processing unit 251 creates hot position display messages (see FIG. 14) as additional images for betting positions regarding which the total expected value of the number of pips on the dice is ranked first to M-th (M=3 in this embodiment).

Figure 14:
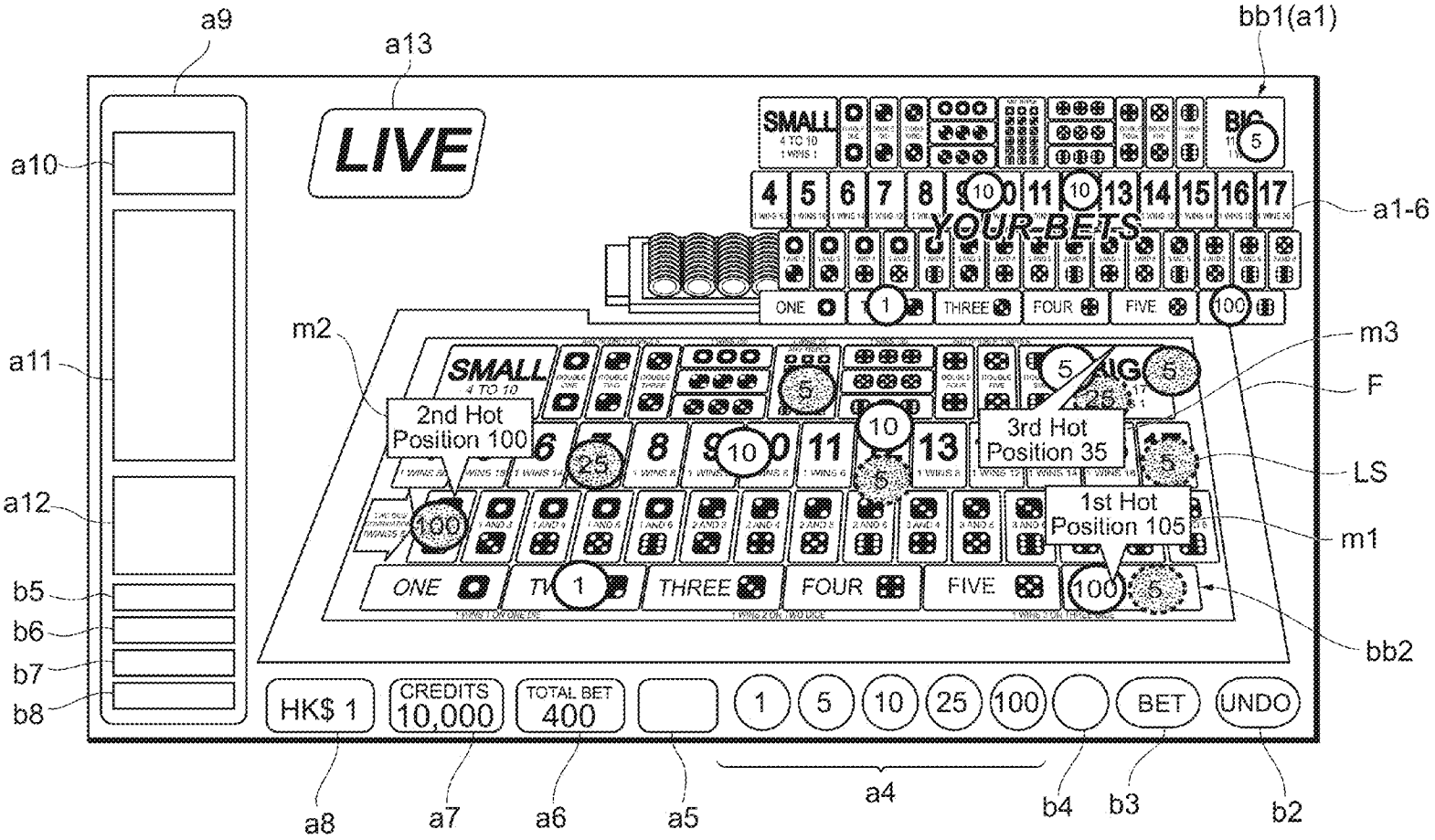
FIG. 14 is a diagram illustrating an example of a display image when the betting operation proceeds in the second display mode.

(d) The image processing unit 251 generates an image obtained by synthesizing the first display image for the player's own betting board (the first betting board) with the second display image (including the additional image(s) as necessary) and displays the synthesized image on the display panel 2 (see FIG. 14).

B. Explanation of Display Images

B-1. Display Image in First Display Mode

The "first display mode" is a display mode selected when the status is the betting processing mode and the operation status of the display switching button 283 is the first operation state (for example, the state of not being pressed). In the first display mode, the first display image is displayed. The first display image can be also paraphrased as a normal game display because it does not include any live screen image relating to the second display image.

Figure 11:
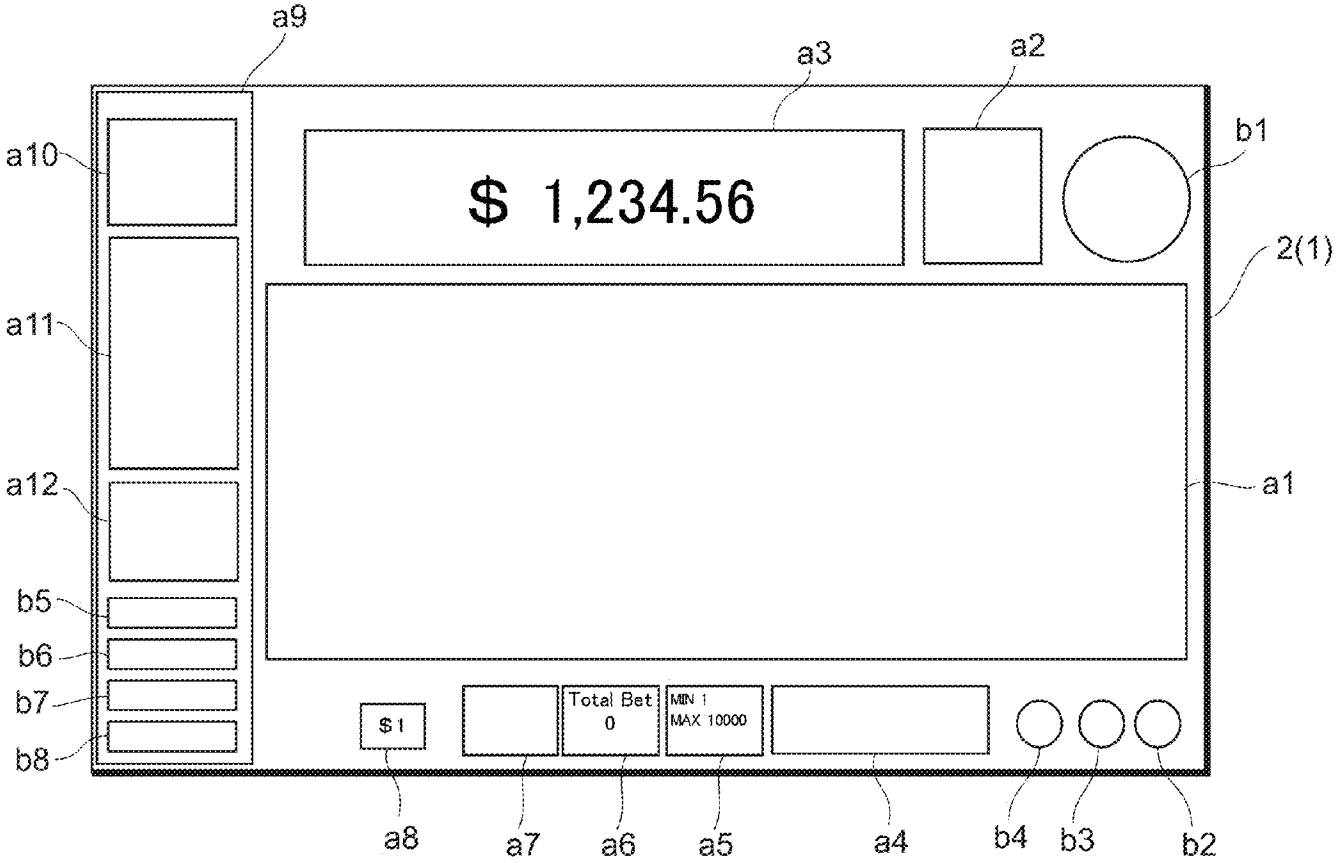
FIG. 11 is a diagram illustrating an example of a first display image in a first display mode.

FIG. 11 illustrates an example of the first display image displayed on the display panel 2 in the first display mode. Each part in the image displayed on the display panel 2 is a part which becomes an object to be operated on the touch panel 1 by the player.

Referring to FIG. 11, the first display image is provided with respective display areas of a betting board display area a1, a jackpot bet dividend display area a2, a jackpot meter display area a3, a bet-based switching area a4, a bettable range display area a5, a total bet amount display area a6, a remaining credit amount display area a7, a denomination set value display area a8, an auxiliary display area a9, a remaining bet time display area a10, a history display area a11, and a bar graph display area a12.

(a1) The betting board display area a1 is an area for displaying the betting board for the player to directly make a bet. The details of operation of the area will be explained later.

(a2) The jackpot bet dividend display area a2 is an area for displaying an amount of dividends assigned to a jackpot betting game.

(a3) The jackpot meter display area a3 is an area for displaying an amount of dividends of a winning combination (for example, when the same number of pips appears on all the dice, that is, "triplets") in the jackpot betting game.

(a4) The bet-based switching area a4 is an area for displaying chips which can be operated by the player in order to make a bet. For example, chips based on credits of "1," "5," "10," "25," and "100" are aligned and displayed in this area a4. Preferably, different colors should be used for the respective chips. For example, different colors are used and set by assigning white to "1," red to "5," blue to "10," green to "25," and black to "100" so that which types of chips they are can be recognized at a glance. Incidentally, when a user touches any of the chips (for example, "10") to select the chip, that chip will be enlarged and displayed. This enlarged display enables the player to reliably visually recognize which chip the player themselves has selected.

(a5) The bettable range display area a5 is an area for displaying a minimum price and a maximum price which can be bet during one game by using one or more chips.

(a6) The total bet amount display area a6 is an area for displaying a total number of credits of the chips which are bet on the betting board during the game.

(a7) The remaining credit amount display area a7 is an area for displaying the player's total number of remaining credits accumulated at the relevant station machine 200.

(a8) The denomination set value display area a8 is an area for displaying the number of credits assigned per unit cash, which is set by the operator or clerks of the dice game. As this denomination set value is increased to a higher value, more credits can be earned by using the same amount of cash.

(a9) The auxiliary display area a9 is an area for displaying useful information when the player plays the dice game.

(a10) The remaining bet time display area a10 is an area for displaying countdown of remaining bettable time in the betting processing mode (during a betting period). Moreover, the area a11) is also an area for displaying the number of pips appearing on the three dice in the lottery result display mode. The number of pips on the dice can be displayed in a live image captured by the pip-count detector 120 for the dice lottery apparatus 100 by using the image sensor 212.

(a11) The history display area a11 is an area for displaying a history of a certain number (for example, 20 times) of games in the past. The history displayed comprises, for example, the number of pips on the dice, the total number of pips, and category display indicating in which category the total number of pips is classified, with respect to each of the games in the past. Regarding examples of the category, it is possible to display: "TRIPLE" when the number of pips on the dice is "triplets"; "SMALL" when the number of pips on the dice is equal to or less than a specified number (for example, "10"); and "BIG" when the number of pips on the dice is greater than the specified number.

The player can perform the betting operation by referring to the history displayed in the history display area a11 and predicting the number of pips appearing on the dice D in a current game.

(a12) The bar graph display area a12 is an area for displaying bar graphs in the form of histograms which show the history of the number of pips on the dice for a certain number of times in the past (for example, 10 times) on the basis of each number of pips on the dice, bar graphs in the form of histograms which show the history of the number of pips on the dice on the basis of each category such as "TRIPLE," "SMALL," or "BIG," and bar graphs showing the appearance frequency of "TRIPLE."

Furthermore, respective operation buttons, that is, a jackpot betting button b1, a clear button b2, an undo button b3, a double bet button b4, a history display change button b5, a language switch button b6, a scene switch button b7, and a game rule display button b8 are displayed in the first display image as illustrated in FIG. 11.

(b1) The jackpot betting button b1 is an input icon to be operated when making a bet in a jackpot betting game.

(b2) The clear button b2 is an input icon to be operated when resetting all operations to make the bet in the game during a betting period.

(b3) The undo button b3 is an input icon to be operated when cancelling operation performed immediately before and returning the operation status to a previous operation status.

(b4) The double bet button b4 is an input icon to be operated when additionally betting a betting amount twice as much as the betting amount which has been bet on the betting position until now. However, this button can no longer be operated when the betting amount exceeds the maximum betting amount displayed in the bettable range display area a5 by operating this button.

(b5) The history display change button b5 is an input icon to be operated when changing the mode of history displayed in the history display area a11 and the bar graph display area a12. For example, it is possible to change the mode of history by means of toggle operation to the following display modes every time the history display change button b5 is operated.

(b5-1) To display the history of 20 games in the past in a combined area of the areas a11 and a12.

(b5-2) To display the history of 10 games in the past in the area a11 and display bar graphs of the history of the number of pips on the dice in the area a12.

(b5-3) To display the history of 10 games in the past in the area a11 and display category-based bar graphs in the area a12.

(b5-4) To display the history of 10 games in the past in the area a11 and display bar graphs of appearance frequency of "TRIPLE" when the same number of pips appeared on all the three dice D, in the area a12.

(b6) The language switch button b6 is an input icon to be operated when switching the display between various languages (for example, from English to Chinese or from Chinese to English).

(b7) The scene switch button b7 is an input icon to be operated when changing, for example, the color of the background according to the player's tastes. For example, it is possible to sequentially switch the color of the background from green to red, then white, and then gold every time the operation to press the scene switch button b7 is performed.

(b8) The game rule display button b8 is an input icon to be pressed when checking rules of this dice game. For example, it is possible to display the betting boards and odds as well as basic rules of the dice game by operating the game rule display button b8.

Figure 12:
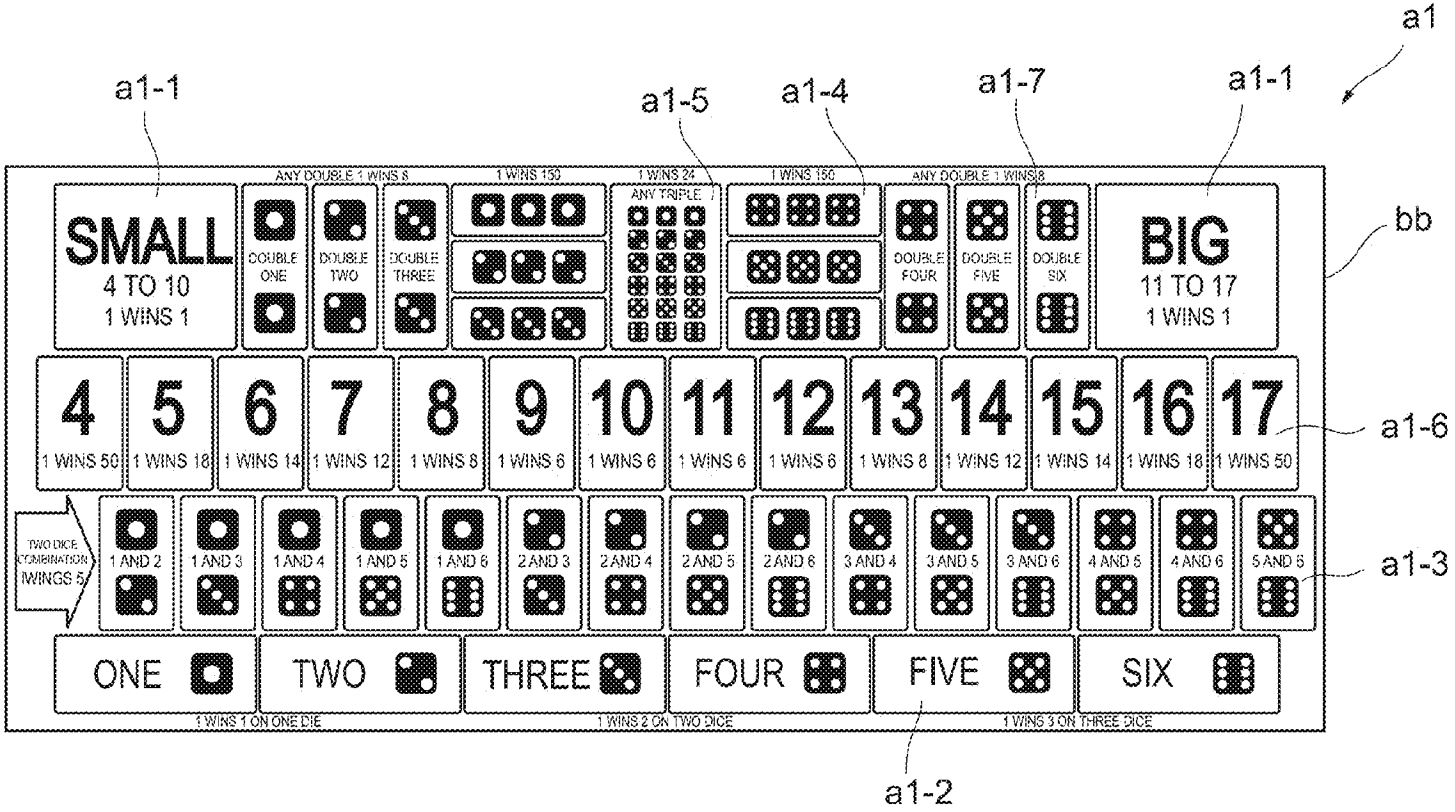
FIG. 12 is a diagram illustrating an example of a display image of a betting board.

FIG. 12 illustrates a display image of a betting board displayed in the betting board display area a1. Referring to FIG. 12, a betting board bb corresponds to a real betting board and comprises respective areas of a Big/Small area a1-1, a Specific Single Dice area a1-2, a Specific Double area a1-3, a Specific Triple area a1-4, an Any Triple area a1-5, a Three Dice Total area a1-6, and a Two Dice Combination area a1-7.

(a1-1) The Big/Small area a1-1 is an area for making a bet by predicting whether a total value of pips on the three dice D is big or small ("Big/Small"). For example, when the player predicts that the total value of pips on the three dice D is "4 to 10," the player bets on "Small," that is, "a small number"; and when the player predicts that the total value of pips on the three dice D is "11 to 17," the player bets on "Big," that is, "a large number." Incidentally, when the number of pips on the dice is "triplets" (for example, "1, 1, 1"), it means a loss.

(a1-2) The Specific Single Dice area a1-2 is an area for making a bet by predicting the number of pips on one dice D (that is, "Single") from among the three dice D.

(a1-3) The Specific Double area a1-3 is an area for making a bet by predicting the number of pips on two dice D (that is, "Double") from among the three dice D.

(a1-4) The Specific Triple area a1-4 is an area for making a bet by betting that the same number of pips would appear on all three dice D (that is, "Triple"), and predicting that number appearing on the dice D.

(a1-5) The Any Triple area a1-5 is an area for making a bet by predicting that the same number of pips would appear on all three dice D regardless of the number of pips (that is, "Any Triple").

(a1-6) The Three Dice Total area a1-6 is an area for making a bet by predicting the total value of pips on the three dice D (that is, "Three Dice Total").

(a1-7) The Two Dice Combination area a1-7 is an area for making a bet by predicting the number of pips on two dice (that is, "Two Dice Combination") from among the three dice D.

Dividends in the first betting board display area a1 described above are set by, for example, the control program for the dice game in advance. For example, a dividend earned when the player wins the Big/Small area a1-1 is 1:1 (one pay-out for one bet: "1 WINS 1"); and the dividend earned when the player wins the Specific Double area a1-3 is, for example, 1:5.

After receiving lottery result information including pip-count information from the master machine 300, the station control unit 210 judges whether the player has won the bet or not, by comparing this pip-count information with the number of pips on the dice indicated by the betting status designated by the player's betting operation.

B-2. Display Image in Second Display Mode

The "second display mode" is a display mode selected when the status is the betting processing mode and the operation status of the display switching button 283 is in a second operation state (for example, in a state of being pressed). In this embodiment, a synthetic image which is obtained by synthesizing the live screen image (the second display image), which shows the pip-count prediction status of all the station machines 200 on the second betting board, with the aforementioned first display image is displayed in the second display mode.

Figure 13:
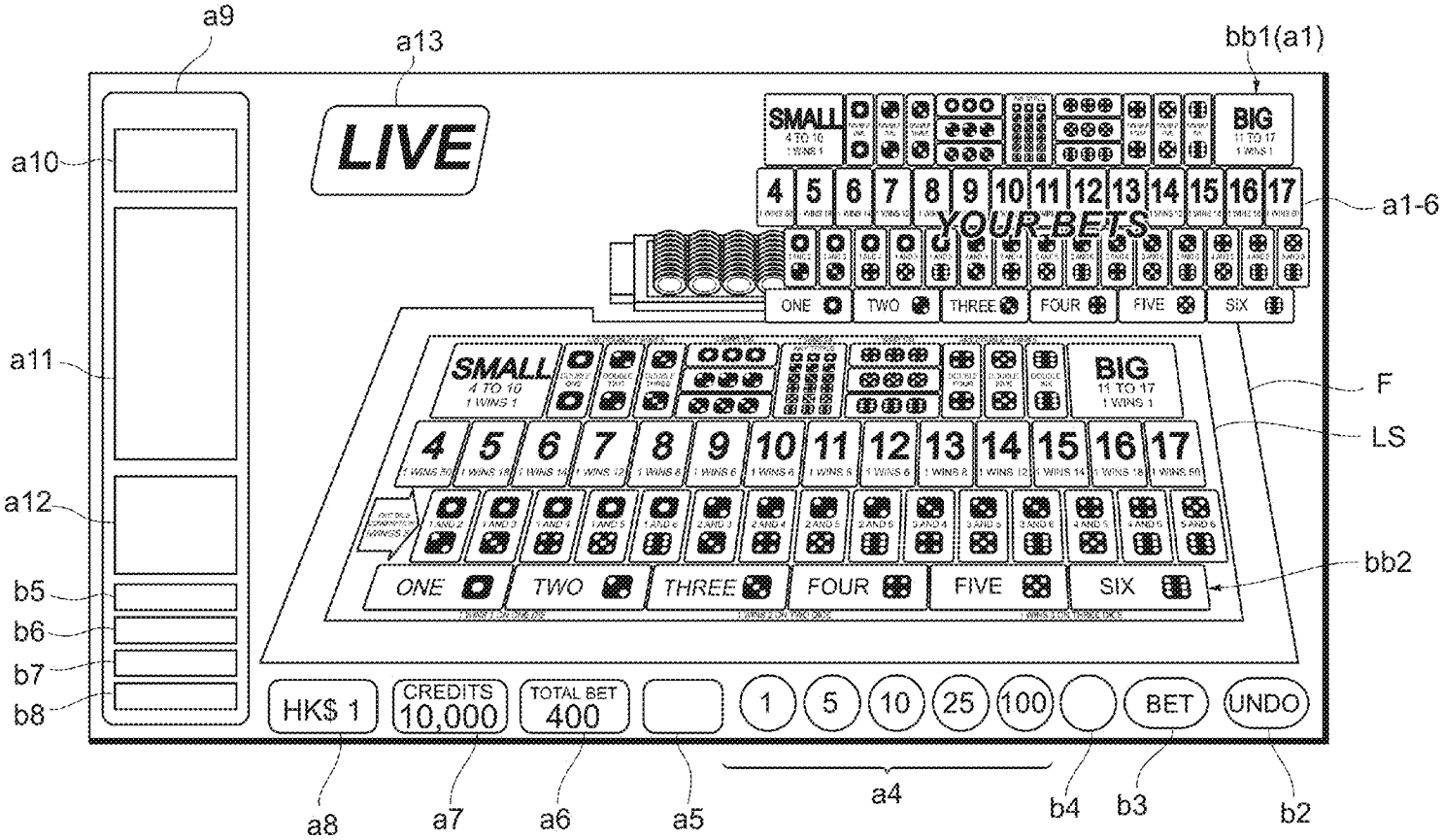
FIG. 13 is a diagram illustrating an example of a display image before betting operation in a second display mode.

FIG. 13 illustrates an example of an image displayed on the display panel 2 in the second display mode. Referring to FIG. 13, in the second display mode, the live screen LS corresponding to the second display image is dominantly displayed on the display panel 2 in place of the first betting board bb1 corresponding to the first display image. The live screen LS is an image similar to an image displayed on the monitor 331 by the master machine 300, that is, the image in which the pip-count prediction status (the integrated operation status) of all the station machines 200 including the player's own station machine 200 and other station machines 200 is reflected on the second betting board bb2. Image processing should preferably be executed on the live screen LS so that the live screen LS would be inserted into inside of frame F which is illustrated like a 3D display virtually as the background. Specifically speaking, the station control unit 210 generates the image of the live screen LS by referring to the integrated operation information stored in the RAM 213 and reflecting the integrated operation status on the second betting board bb2 as illustrated in FIG. 13.

Next, image deformation conversion is performed so that the outer shape of the image of the live screen LS will become a substantially trapezoidal shape. Then, the image of the live screen LS is positioned so as to make it fit inside the frame F of the display panel, and the live screen LS is put inside the frame F. When the image of the live screen LS is reduced in a vertical direction as a result of such image deformation conversion, a display space is generated above the live screen LS in the display panel 2.

This embodiment is characterized in that: the betting board display area a1 is provided above the live screen LS where the space is secured; and the image which is obtained by synthesizing the first betting board bb1 with the live screen LS is displayed.

The image of the first betting board bb1 is an image of a shape similar to that of the betting board bb displayed in the betting board display area a1 in the first display mode. This embodiment is configured so that in the second display mode, the player can also perform the betting operation on the first betting board bb1 in the same manner as in the first display mode. Furthermore, in order to inform the player that they can perform the betting operation on the betting board display area a1, specified display such as a text display of, for example, "YOUR BETS" should preferably indicated in the image of the first betting board bb1.

Incidentally, in the second display mode, display areas a4 to a8 and operation buttons b2 to b4 are displayed below the display panel 2 and display areas a10 to a12 and operation buttons b5 to b8 are displayed in the auxiliary display area a9 on the left side of the display panel 2. Since image displays of these display areas a4 to a12 and operation buttons b2 to b8 are the same as those in the first display mode explained with reference to FIG. 11, the same reference numerals are assigned to them and any specific explanation about them has been omitted.

In the second display mode, "LIVE" and "ALL PLAYER'S BETS" are text displayed in the live display area a13 as illustrated in FIG. 13. These text displays enable the player to recognize that the image displayed on the display panel 2 is the live screen LS and the operation status of all players is reflected on the live screen LS.

FIG. 14 illustrates an example of the synthetic image displayed when the betting operation at the plurality of station machines 200 during the betting period in the betting processing mode is completed. Referring to FIG. 14, the first display image in which the player's own betting status is reflected on the player's own betting board bb1 is displayed in an upper right portion of the display image. Furthermore, the live screen LS (the second display image) based on the integrated operation information, indicating a state where a plurality of chips are being bet on a plurality of betting positions, is displayed at the center of the display image.

Now, referring to FIG. 14, the hot position display messages m1 to m3 should preferably be displayed as the additional images in the live screen LS. A method for generating the hot position display messages m1 to m3 is almost the same as the display control method for the live screen LS in the master display device 330 as explained with reference to FIG. 7. Referring to FIG. 14, a betting position on which the largest betting amount is bet at the relevant point in time is "SIX" in the Specific Single Dice area a1-2 with the total number of credits 105; and the number of credits "105" together with the hot position display message ("1st HOT POSITION") m1 is displayed near the relevant betting position. Furthermore, a betting position on which the second largest betting amount is bet at the relevant point in time is a combined area of the number of pips "1" and "2" on the dice in the Specific Double area a1-3 with the total number of credits 100; and the number of credits "100" together with the hot position display message ("2$^{nd}$ hot position") m2 is displayed near the relevant betting position. Furthermore, a betting position on which the third largest betting amount is bet at the relevant point in time is a "BIG" area of the Big/Small area a1-1 with the total number of credits 35; and the number of credits "35" together with the hot position display message ("3$^{rd}$ hot position") m3 is displayed near the relevant betting position. Incidentally, in FIG. 14, the betting positions of the total betting amounts ranked first to third are objects for which to display the hot position display messages; however, the settings for, for example, for how many ranks the hot position display messages should be displayed can be changed as appropriate according to, for example, the design of the station machines 200. It is possible to make the player instantly understand the betting positions on which many chips (that is, credits) are being bet by displaying the additional images like such hot position display messages m1 to m3.

Incidentally, the explanation about the above-mentioned display image is just for illustration of an example and there is no limitation on the details of designs and positions of the first display image, the second display image, and the additional images.

For example, the above-described live screen may be displayed in display modes so as to make it possible to easily visually comprehend how many players are betting on each betting position (for example, by the method of using different colors for the chips or by the method of displaying the number of players in a peripheral area) as specifically explained in detail with reference to FIG. 7.

C. Basic Operations

When the dice game is started, the mode enters the betting processing mode, the betting period enabling the player to perform the betting operation starts, and the first display image as illustrated in FIG. 11 is displayed on the display panel 2. Furthermore, as the player makes the display switching button 283 be in a pressed state, the synthetic image obtained by synthesizing the second display image corresponding to the live screen LS with the first display image as illustrated in FIG. 13 is displayed on the display panel 2.

In either display mode, each player makes a bet by predicting the number of pips on the dice D and operating the touch panel 1 of the station machine 200 assigned to that player. In the first display mode, the player performs the betting operation on the betting board bb displayed in the betting board display area a1. In the second display mode, the player determines the player's own betting operation and performs the betting operation on the first betting board bb1 displayed in the first betting board display area a1 while comprehending the betting status of other station machines 200 as displayed on the second betting board bb2 of the live screen LS.

There is basically no difference between the betting operation in the first display mode and the betting operation in the second display mode. The betting operation in the second display mode will be explained below as an example.

C-1. Chip Movement Operation

Figure 15:
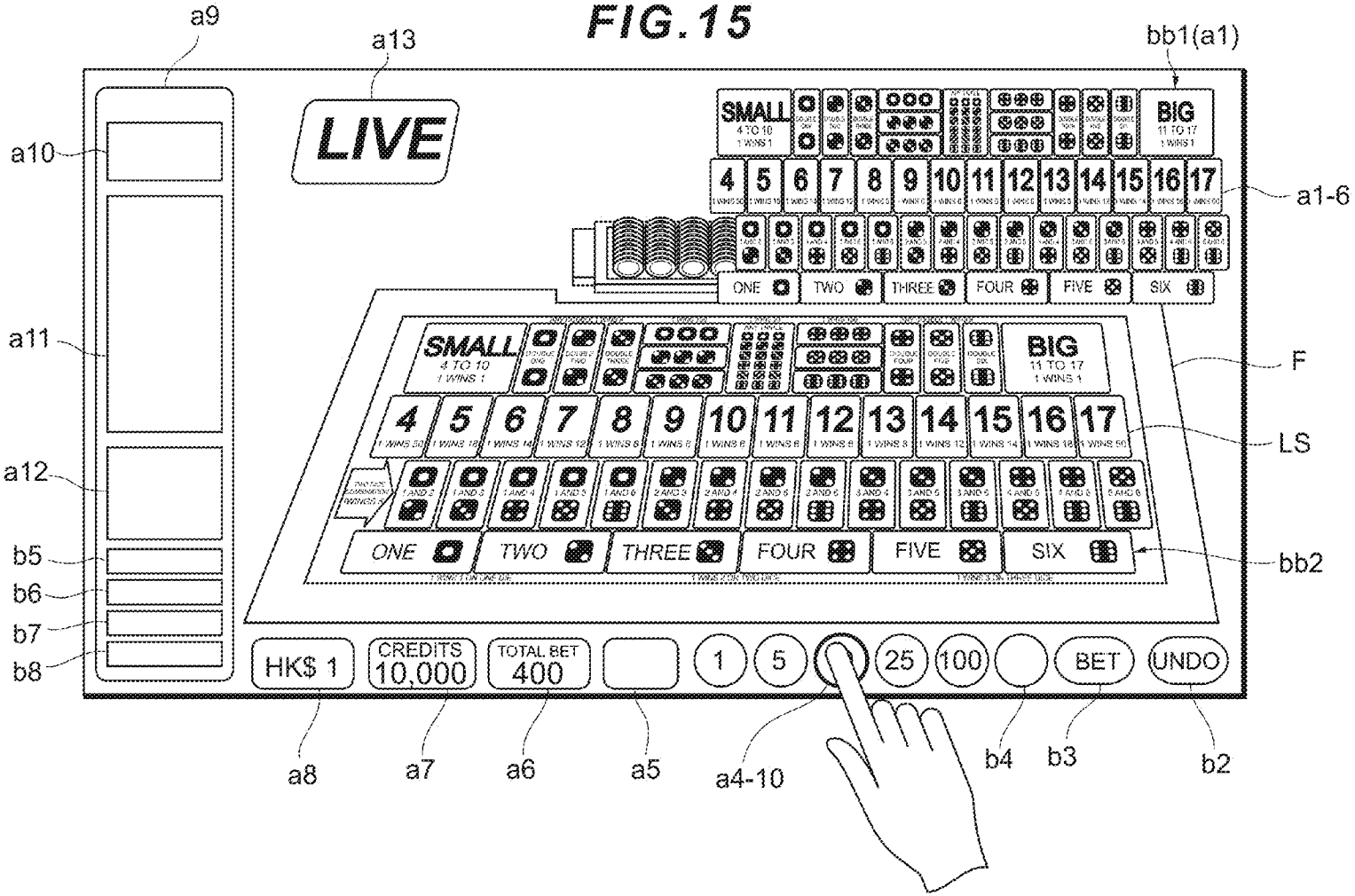
FIG. 15 is a diagram illustrating an example of procedure (1) for chip movement operation in the second display mode.
Figure 16:
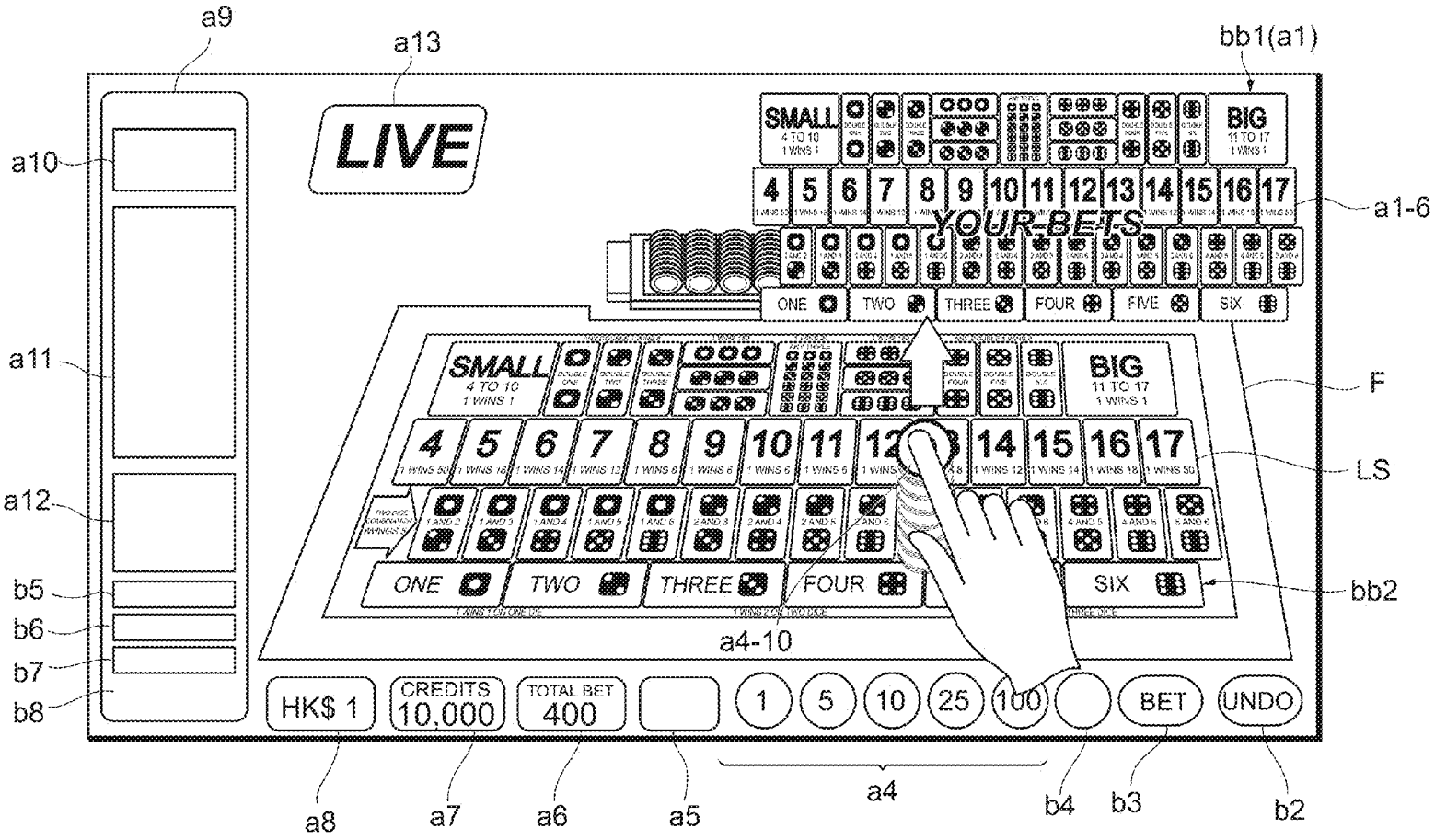
FIG. 16 is a diagram illustrating an example of procedure (2) for the chip movement operation in the second display mode.

It is also possible to bet on a desired betting position by setting a chip in a temporarily selected state and then dragging the chip. Specifically speaking, the player selects and touches a chip of the number of credits which the player wants to bet, from among the chips displayed in the bet-based switching area a4 (chip a4-10 in FIG. 15). By touching the chip for a certain amount of time (for example, for 200 ms or longer), the relevant chip enters the temporarily selected state and the relevant chip is displayed in a slightly larger size as if in an excited state. When the player drags their finger in a desired direction in this state, the chip is displayed as if it follows the movement of the finger (the chip a4-10 in FIG. 16).

Figure 17:
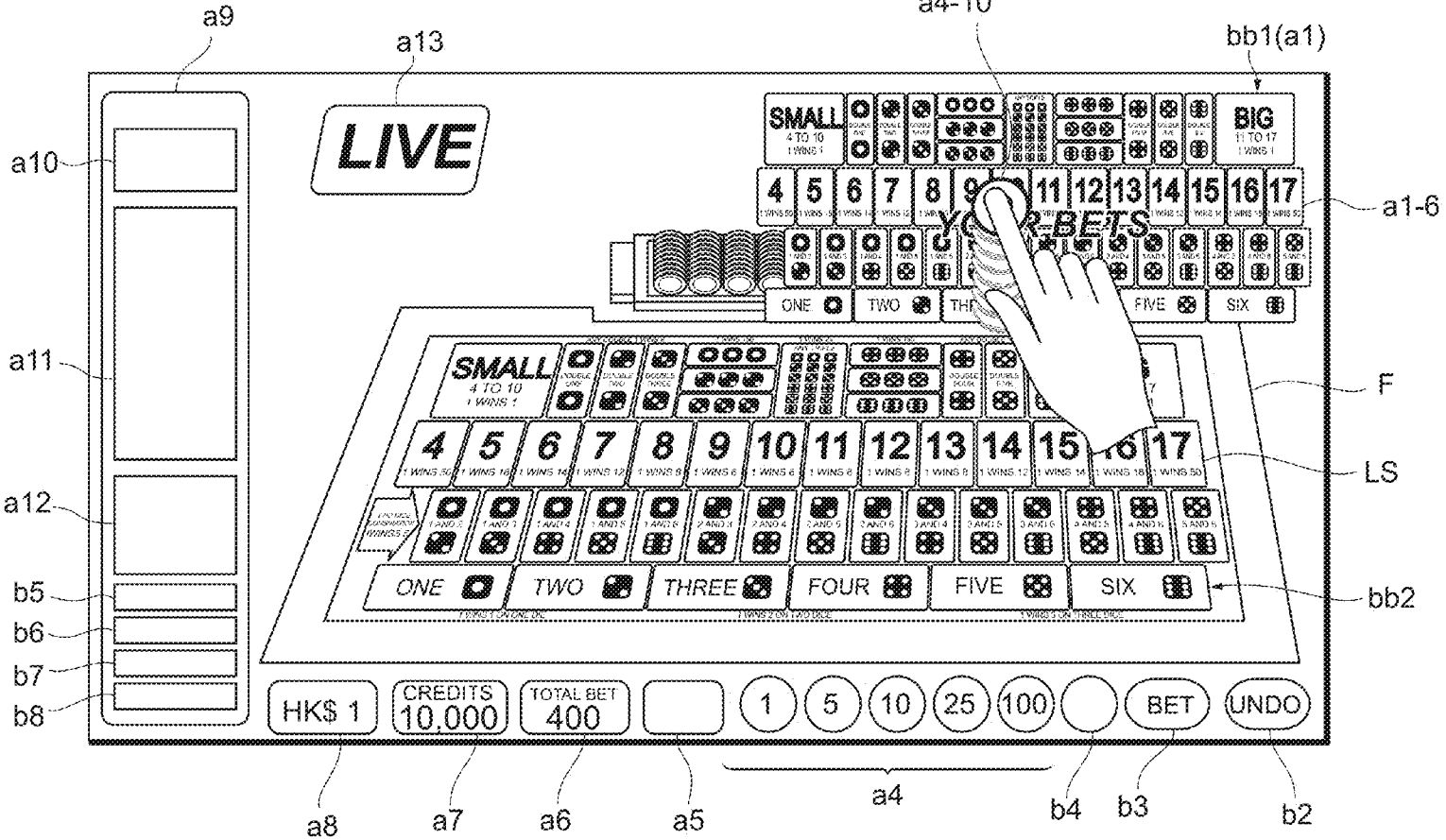
FIG. 17 is a diagram illustrating an example of procedure (3) for the chip movement operation in the second display mode.
Figure 18:
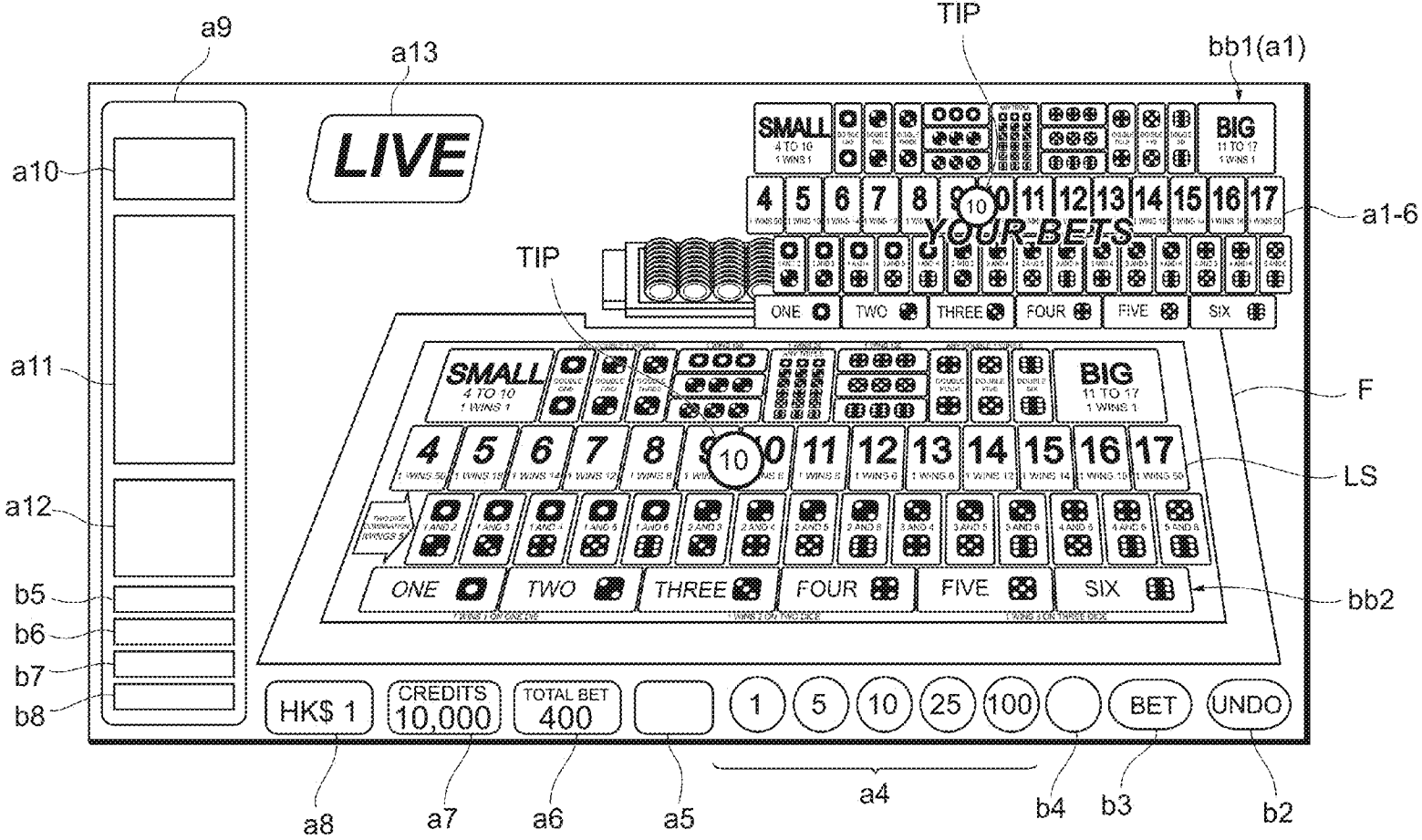
FIG. 18 is a diagram illustrating a case where one chip movement operation in the second display mode has been completed.

Now, when the player drags the chip to the first betting board bb1, on which the chip can be bet, and releases their finger from the touch panel 1 at a desired betting position on the first betting board bb1, the chip stops and is displayed at the betting position where the finger is released, thereby completing betting of the chip by the movement operation (the chip a4-10 in FIG. 17). In an example of FIG. 18, chip TIP is bet on a boundary between the number of pips "9" and "10" on the dice in the Three Dice Total area a1-6 of the first betting board bb1. This betting status is also reflected on the live screen LS which displays the betting status of all the station machines 200 and such betting status is also transmitted from the relevant station machine 200 via the master machine 300 to other station machines 200.

Then, the image in which the chip TIP is bet on the boundary between the number of pips "9" and "10" on the dice in the Three Dice Total area a1-6 of the second betting board bb2 in the same manner as on the first betting board bb1 is displayed on the live screen LS displayed at all the station machines 200. The same image is also displayed on the live screen LS displayed on the monitor 331 managed by the master machine 300.

C-2. Instant Betting Operation

Figure 19:
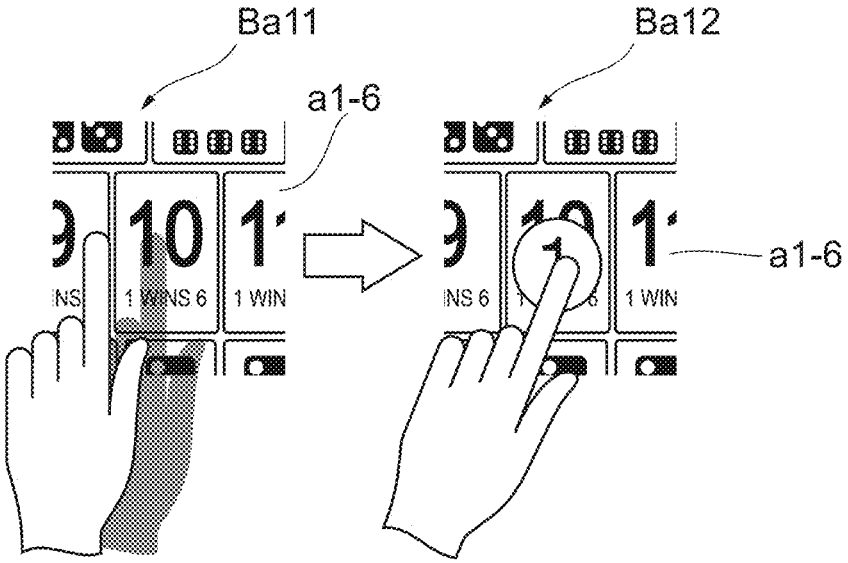
FIG. 19 is a diagram for illustratively explaining instant betting operation.

Instant betting operation is performed by setting a chip in the temporarily selected state and then touching a desired betting position with, for example, a finger. Specifically speaking, let us assume that the player selects and touches a chip with the number of credits, which the player wants to bet, from among the chips displayed in the bet-based switching area a4 and makes the relevant chip enter the temporarily selected state. For example, let us assume that as a result of the touch operation, a chip "1," the number of credits of which is 1, enters a selected state. Next, the player touches a betting position on the betting board bb on which the player wants to bet. For example, the player touches a betting position "10" in the Three Dice Total area a1-6 as illustrated in Ba11 in FIG. 19. As a result of this touch operation, the temporarily selected chip "1" is instantly displayed on the relevant betting position, so that the temporarily selected chip is bet on the relevant betting position. For example, the chip "1" is displayed on the betting position "10" as illustrated in Ba12 in FIG. 19.

C-3. Chip Overlaying Operation

Figure 20:
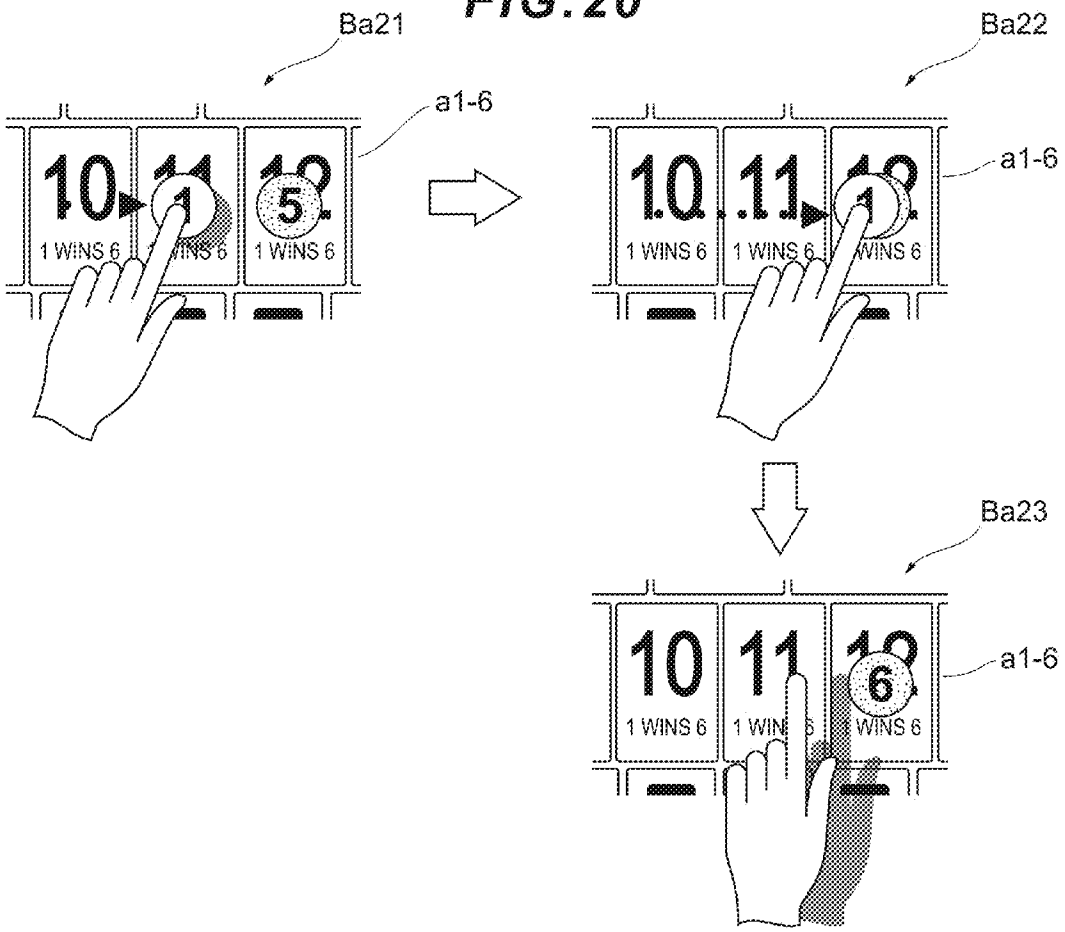
FIG. 20 is a diagram for illustratively explaining overlaying operation.

It is possible to bet a plurality of chips on the same betting position and display the chips by overlaying one chip over another. While a certain chip is bet on a specified betting position, the player drags another chip onto the chip. For example, while a chip "5" with the number of credits "5" is bet on a betting position "12" in the Three Dice Total area a1-6 as illustrated in Ba21 in FIG. 20, the chip "1" which has been dragged is placed over the chip "5" which is bet on the betting position "12" as illustrated in Ba22; and then the player releases the finger. As a result of this processing, for example, the display of the chip "1" overlaid on the chip "5" is changed to a display in which the text display on the surface of the chips is changed to a total number of credits "6" of both the chips as illustrated in Ba23.

In this way, the total betting amount on the limited betting position can be easily visually recognized by the player by performing the overlaying operation to change the text display of the chips overlaid one over another to the total number of credits of the chips which are bet on the relevant betting position.

Incidentally, when any chip is being moved at the time of termination of the betting period, the betting operation relating to that chip is treated as canceled, an image of the moving chip disappears and the credit of the chip is returned to the credits owned by the player.

C-4. Chip Deletion Operation

It is possible to cancel the betting operation on a chip by moving the chip to a position which is not a valid betting position. When the chip is bet on any of valid betting positions and the player then moves the chip to a position which is not a valid betting position and then releases their finger, the betting operation on that chip is canceled, the image of that chip is deleted, and the credit of the deleted chip is refunded to the credits owned by the player.

C-5. Clearing Processing, Undo Processing, Double-Betting Processing

All the operations during the relevant betting period can be canceled by performing the operation to press the clear button b2. The images of the chips which have been bet are deleted and the credits of the deleted chips are converted to the credits owned by the player.

When the operation to press the undo button b3 is performed, the last operation can be reversed (that is, canceled). The credits relating to the last operation are converted to the credits owned by the player. When the operation to press the double bet button b4 is performed, double-betting processing can be executed.

D. Explanation about Processing Flowchart of Each Device

D-1. Master Machine 300

Figure 21:
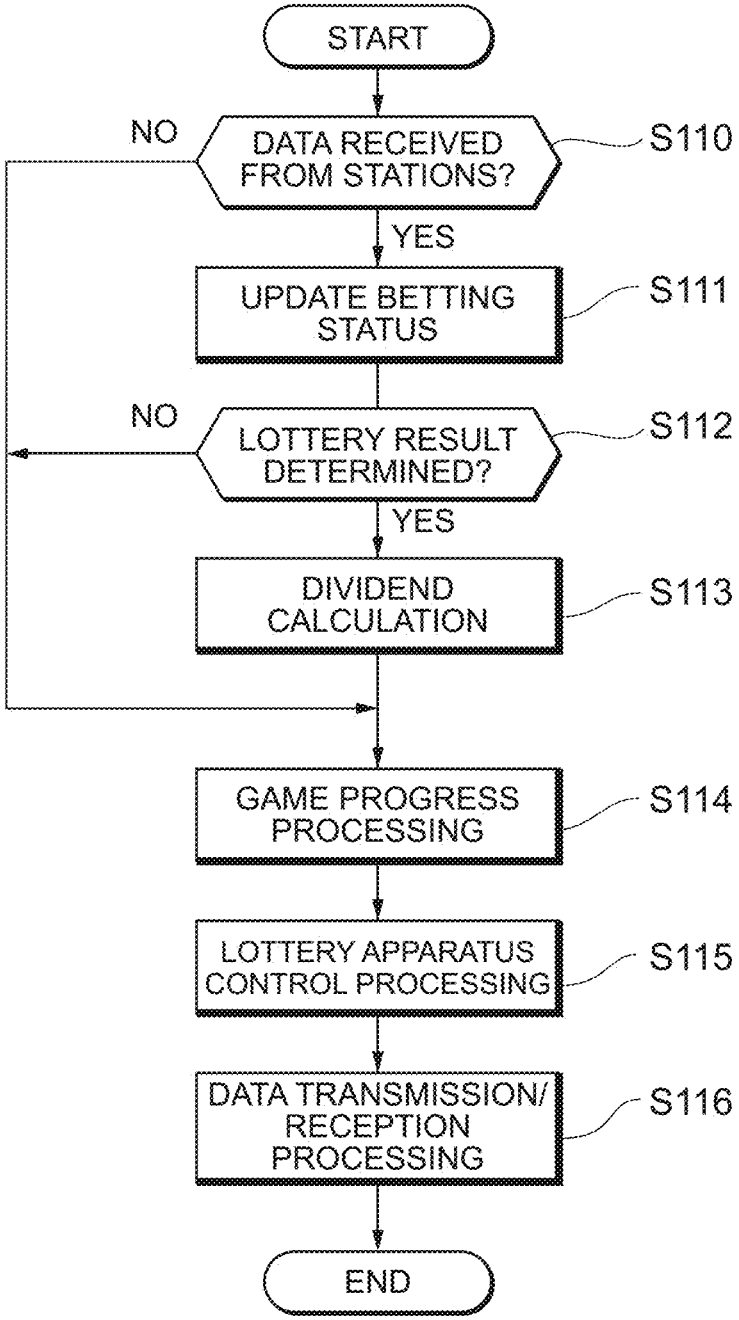
FIG. 21 is an example of a flowchart explaining operation of the master machine according to the embodiment.

FIG. 21 illustrates a flowchart for explaining processing executed by the master machine 300. Master processing relating to this flowchart is repeatedly executed periodically at every specified update timing (for example, every 1/60 seconds). Incidentally, the processing content of the following respective steps is just for illustration, so the order of the steps may be switched, or a plurality of steps may be processed as one step, or one step may be separated into a plurality of steps to be processed.

First, the main control unit 310 for the master machine 300 judges whether it has received data from each station machine 200 or not (step S110). When it is determined that the data is not received (step S110: NO), the main control unit 310 skips step S111 to step S113 and then proceeds to step S114 and executes game progress processing. When it is determined that the data from each station machine 200 is received (step S110: YES), the main control unit 310 determines the type of the received data; and when the received data relates to a change of the betting status at the station machine 200, the main control unit 310 updates the integrated operation information stored in the RAM 313 (step S111). Next, the main control unit 310 judges whether the dice lottery by the dice lottery apparatus 100 is determined or not (step S112). Specifically speaking, when the main control unit 310 receives the dice image data from the dice lottery apparatus 100 and determines the number of pips on the dice D (that is, obtains the pip-count information) by analyzing the dice image data, the main control unit 310 determines that the result of the dice lottery is determined. When the result of the dice lottery is not determined (step S112: NO), the main control unit 310 proceeds to the game progress processing in step S114; and when the result of the dice lottery is determined (step S112: YES), the main control unit 310 proceeds to dividend calculation processing (step S113). During the dividend calculation processing in step S113, the main control unit 310 recalculates dividends relating to the jackpot betting game and obtains a maximum display value to be displayed on a jackpot meter in the next game.

Next, the main control unit 310 proceeds to step S114 and executes the game progress processing. For example, when the game is in the betting processing mode, the main control unit 310 calculates a remaining betting period, tallies the betting amount on each betting position on the basis of the integrated operation information stored in the RAM 313, calculates the number of credits at each betting position and the total number of credits which have been bet, and updates the display image of the live screen LS. Furthermore, for example, when the game is in the lottery result display mode, the main control unit 310 executes processing relating to the jackpot game and calculates the amount of dividends at each station machine 200 on the basis of the lottery result from the dice lottery apparatus 100. Next, the processing proceeds to step S115 and the main control unit 310 controls the dice lottery apparatus 100. For example, when the time has come to start the next game, the main control unit 310 generates an instruction to toss the dice D; and when the time has come to start the dice lottery, the main control unit 310 generates a fan stop instruction and a shutter closing instruction. When this series of processing is completed, the processing proceeds to step 116 and the main control unit 310 transmits various data generated in each of the above-described steps to each station machine 200. For example, when the integrated operation information is updated in step S111, the main control unit 310 transmits this information to each station machine 200. When the main control unit 310 generates, for example, the dice D tossing instruction, the fan stop instruction, and the shutter closing instruction in step S115, the main control unit 310 transmits these instructions to the dice lottery apparatus 100.

D-2. Station Machine 200

Figure 22:
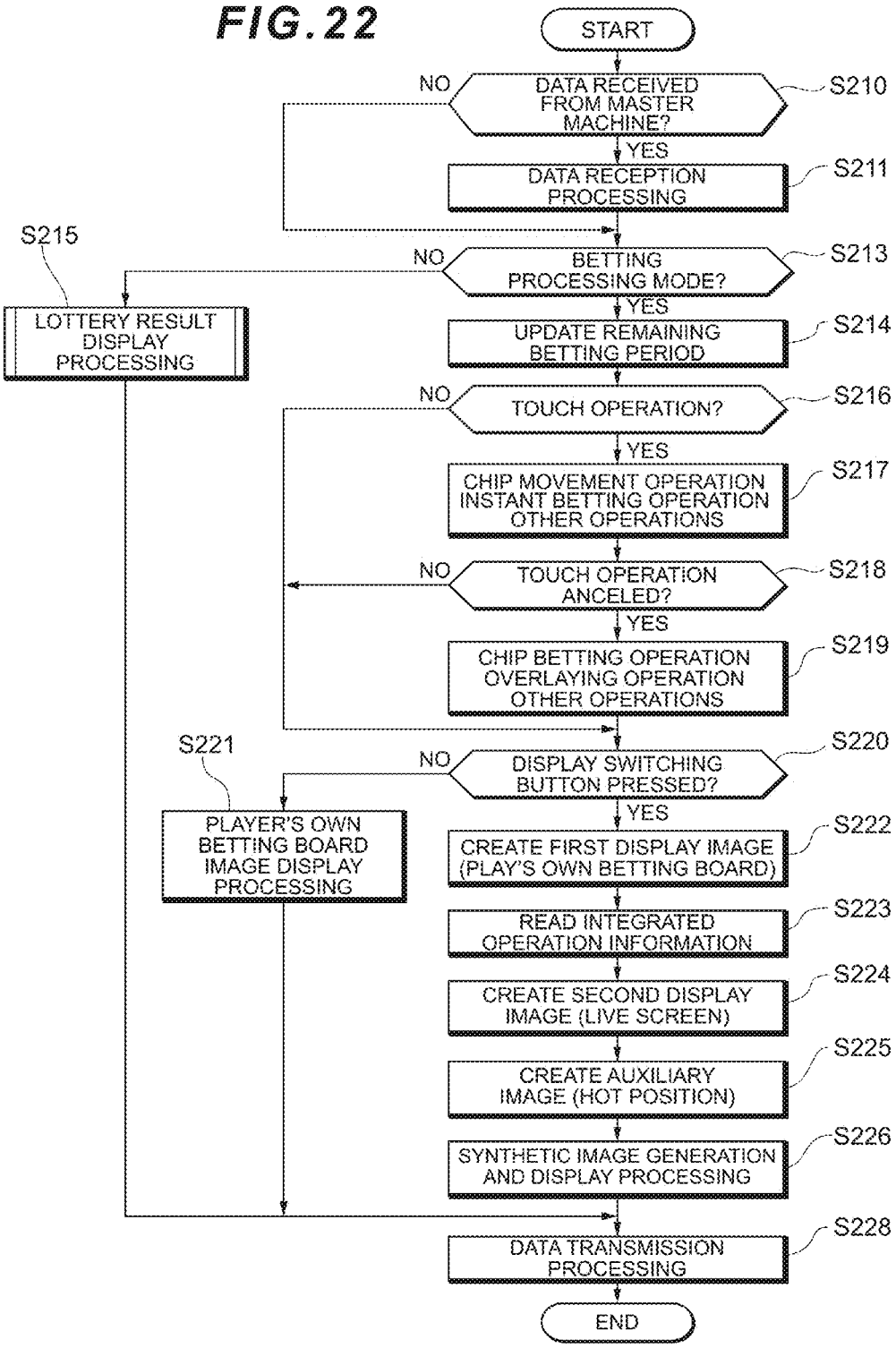
FIG. 22 is an example of a flowchart explaining operation of the station machine according to the embodiment.

FIG. 22 illustrates a flowchart for explaining processing executed by the station machine 300. Master processing relating to this flowchart is repeatedly executed periodically at every specified update timing (for example, every 1/60 seconds). Incidentally, the processing content of the following respective steps is just for illustration, so that the order of the steps may be switched, or a plurality of steps may be processed as one step, or one step may be separated into a plurality of steps to be processed.

Firstly, the station control unit 210 for the station machine 200 judges whether it has received data from the master machine 300 or not (step S210). When it is determined that the data is received from the master machine 300 (step S210: YES), the station control unit 210 determines the type of the received data and executes processing of the received data (step S211). For example, having received new integrated operation information, the station control unit 210 updates the integrated operation information stored in the RAM 213.

Furthermore, having received data relating to the mode of the game at the present point in time, the station control unit 210 updates the status according to the mode. Next, the processing proceeds to step S213 and the station control unit 210 judges whether the status of the game at the present point in time is the betting processing mode or the lottery result display mode. If the betting processing directive command is transmitted from the master machine 300 and it can be determined that the status of the game at the present point in time is the betting processing mode (step S213: YES), the station control unit 210 proceeds to step S214 and updates the remaining betting time information displayed in the remaining bet time display area a10. On the other hand, if the lottery result display directive command is transmitted from the master machine 300 and it can be determined that the status of the game at the present point in time is the lottery result display mode (step S213: NO), the station control unit 210 proceeds to step S215 and executes various necessary processing in the lottery result display mode. For example, the station control unit 210 displays an image corresponding to the lottery result display mode on the display panel 2, calculates the number of dividend credits of the player's own station machine 200 on the basis of the lottery result, adds the calculated number of dividend credits to the player's own number of credits, and displays an image corresponding to the number of dividend credits on the display panel 2.

In a case of the betting processing mode, the station control unit 210 judges whether an event relating to the touch operation performed by the player touching the touch panel has occurred or not, in step S216. When the touch operation has been performed (step S216: YES), the station control unit 210 performs various operations according to the operation status (step S217). For example, when the touch operation has been performed on a chip and the touch operation was also performed on the same chip at the last update timing, the station control unit 210 determines that the chip movement operation has been performed, and the station control unit 210 then moves the display of the relevant chip to a new position. Furthermore, for example, when the touch operation has been performed on a specified betting position and a chip which entered the temporarily selected state at the last update timing exists, the station control unit 210 determines that the instant betting operation was designated, and the station control unit 210 displays the chip, which is in the temporarily selected state, at the betting position on which the touch operation has been performed. Furthermore, when the touch operation has been performed on a button or the like other than a chip or a betting position, the station control unit 210 executes other operation assigned to the operated button or the like.

Next, in step S218, the station control unit 210 judges whether the touch operation performed by the player at the last update timing has been canceled or not. When the touch operation has been canceled by, for example, releasing the finger (step S218: YES), the station control unit 210 performs various operations according to the operation status (step S219). For example, when the operation to move a chip had been performed until the last update timing, processing for displaying the chip at a betting position corresponding to the position at which the touch operation has been canceled is executed this time, assuming that the chip has been bet. Furthermore, for example, when another chip is bet at the betting position corresponding to the position at which the touch operation has been canceled, processing for overlaying the chips at the relevant betting position is executed. Furthermore, in a case of cancellation of other touch operations, other operations assigned to, for example, a chip or button on which the touch operation has been canceled are executed.

Next, the processing proceeds to step S220 and the station control unit 210 judges whether the display mode is the first display mode or the second display mode, on the basis of whether the operation to press the display switching button 283 is performed or not. When the display switching button 283 is not pressed (step S220: NO), the station control unit 210 determines that the display mode is the first display mode, and the station control unit 210 executes the image display processing in the first display mode (step S221).

On the other hand, when the display switching button 283 is pressed (step S220: YES), the station control unit 210 determines that the display mode is the second display mode, and the station control unit 210 executes the image display processing in the second display mode in step S222 to S226. Firstly, in step S222, the station control unit 210 generates the first display image, that is, the image of the player's own first betting board bb1. Next, in step S223, the station control unit 210 reads the integrated operation information from the RAM 213; and in step S224, the station control unit 210 generates the second display image, that is, a live screen image obtained by reflecting the betting status of all the station machines 200 on the second betting board bb2. Furthermore, in step S225, the station control unit 210 generates an additional image(s) according to the betting amount at each betting position on the second betting board bb2, that is, a hot position display message(s). Then, in step S226, the station control unit 210 generates an image obtained by synthesizing the first display image on the player's own betting board (the first betting board) with the second display image relating to the live screen and the additional image(s) relating to the hot position(s), and displays the synthesized image on the display panel 2.

Finally, the station control unit 210 transmits data, which is newly generated at this update timing, to the master machine 300 (step S228).

E. Advantageous Effects of this Embodiment (E-1) According to this embodiment, the betting status of all the station machines 200 is reflected on the second betting board displayed in the live screen LS in the second display mode, while only the betting status of the player's own station machine 200 is reflected on the first betting board bb1. Therefore, according to this embodiment, the player can predict the number of pips on the dice at the player's own machine while comprehending the betting status of other station machines 200 in the live screen LS, by pressing the display switching button 283.

(E-2) According to this embodiment, the betting operation can be performed on the player's own betting board bb1 even in the second display mode in the same manner as in the first display mode (normal game). Therefore, according to this embodiment, the player can observe the betting status of other station machines 200 in the live screen LS and continue performing the betting operation on the player's own betting board bb1 at the same time.

(E-3) According to this embodiment, the betting operation can be executed on the player's own betting board bb1 in the same manner in either the first display mode or the second display mode. Therefore, according to this embodiment, the player can continue performing the betting operation on the player's own betting board bb1 without feeling uncomfortable even when switching to the first display mode or to the second display mode. For example, the player can switch the display mode flexibly depending on the situation as follows: when the player wants to focus on the player's own betting operation, they switch to the first display mode; and when the player wants to bet on a betting position for which an expected value for the number of pips appearing on the dice seems to be high, while comprehending the betting status of other station machines 200, they switch to the second display mode.

F. Variations

The embodiments can be changed in various variations to a degree within the gist of the disclosure. For example, the following variations are possible.

(F-1) The aforementioned embodiment is configured so that in the second display mode, the betting operation can be performed on the first betting board bb1 which is the first display image; however, the disclosure is not limited to this example. For example, embodiments may be configured so that the betting operation can be performed on the second betting board bb2 which is the second display image and, instead, the betting operation on the first betting board bb1 which is the first display image may be prohibited and only the player's own betting status may be displayed on the first betting board bb1.

Furthermore, embodiments may be configured so that the betting operation can be performed on both the first betting board bb1, which is the first display image, and the second betting board bb2 which is the second display image.

(F-2) The aforementioned embodiment is configured so that the first display mode is selected when the display switching button 283 is not pressed, and the second display mode is selected when the display switching button 283 is pressed; however, the disclosure is not limited to this example. For example, embodiments may be configured so that the second display mode is selected when the display switching button 283 is not pressed, and the first display mode is selected when the display switching button 283 is pressed. Furthermore, embodiments may be configured so that the display switching button 283 is set to perform toggle operation; and the display mode may be switched between the first display mode and the second display mode every time the display switching button 283 is pressed.

(F-3) The aforementioned embodiment is configured so that in the second display mode, the synthetic image obtained by synthesizing the first display image with the second display image is displayed; however, the disclosure is not limited to this example. For example, in the second display mode, only the second display image, that is, the second betting board bb2 may be displayed instead of the synthetic image. When embodiments are configured in this way, the player will perform the betting operation while watching the player's own betting boar bb in the first display mode, then operate the display switching button 283 to switch to the second display mode, and check the betting status of other station machines while watching the second betting board bb2 (the live screen LS) which is the second display image. In this case, the embodiment may be configured so that the player may be prohibited from performing the betting operation on the second betting board bb2 which is the second display image, but the player may be permitted to perform the betting operation.

(F-4) In the aforementioned embodiment, the image of the second betting board bb2, which is the second display image, is converted, a space is provided in an upper part of the screen of the display panel, and the size of the first betting board bb1 which is the first display image is changed and the changed first betting board bb1 is displayed in the space as the synthetic image obtained by synthesizing the first display image with the second display image in the second display mode; however, the disclosure is not limited to this example. It is possible to determine, as appropriate, to what degree the size, shape, and position of the first display image should be changed, and to what degree the size, shape, and position of the second display image should be changed in the synthetic image. For example, the first display image may be displayed mainly at the center and the size of the second display image may be reduced and the reduced second display image may be displayed in a peripheral area as a reference. Furthermore, instead of the image obtained by superimposing either one of the first display image and the second display image over the other image as in the aforementioned embodiment, a separate window may be displayed and the other image may be displayed in that separate window. Moreover, embodiments may be configured so that the position of the separate window can be changed by, for example, operating a button. Furthermore, embodiments may be configured so that one station machine is provided with a plurality of display panels, the first display image is displayed exclusively on one display panel and the second display image is displayed exclusively on another display panel.

(F-5) In the aforementioned embodiment, the display switching button 283 is provided outside the touch panel 1 (the display panel 2); however, the disclosure is not limited to this example. For example, a virtual operation button corresponding to the display switching button 283 may be displayed as the first display image or the second display image and a function similar to that of the display switching button 283 may be assigned to the virtual operation button.

(F-6) In the aforementioned embodiment, the master machine 300 is connected, but the master machine 300 is not an indispensable constituent element.

Therefore, for example, each station machine 200 and the dice lottery apparatus 100 can be connected to each other and each station machine 200 or the dice lottery apparatus can replace or complement the functions of the aforementioned master machine 300.

(F-7) In the aforementioned embodiment, the dice lottery apparatus 100 is connected, but the dice lottery apparatus 100 is not an indispensable constituent element.

Therefore, for example, the dice lottery function may be replaced with software processing and hardware processing in the master machine 300 or may be replaced with software processing and hardware processing in each station machine 200.

(F-8) In the aforementioned embodiment, the present disclosure is applied to a dice game; however, the disclosure is not limited to this example. For example, embodiments can be applied to any game as long as the game is played by a plurality of players, each player's play is related to other players' play status, and each player is required to comprehend other players' play status. For example, embodiments can be applied to any type of games played by a plurality of players such as roulette games using roulettes or card games using trumps (such as poker, blackjack, and baccarat) instead of the dice game.

(F-9) In the aforementioned embodiment, the touch display panel in which the touch panel 1 is placed over the display panel 2 is applied; however, the disclosure is not limited to this example. For example, embodiments may be configured so that the touch panel may be provided separately without being placed over the display panel or the player's operation may be input by means of any input means other than the touch panel, for example, a touch pen, a keyboard, a trackball, or a joystick.

(F-10) In the aforementioned embodiment, the master machine 300 and the station machines 200 illustrated in FIG. 1 are constituted mainly by dedicated computer devices, but the present disclosure is not limited to this example. For example, mobile computers, mobile terminals, and game devices can be applied as long as they are computer devices that can be connected to the network 400.

The game machine, the dice game system, and the display program according to embodiments as described above can significantly enhance the excitement, attractiveness, and amusement of a game using, for example, dice as compared to conventional game machines as described above, and the player's sense of participation in the game and willingness to continue the game can be enhanced. Therefore, the game machine, the dice game system, and the display program according to embodiments can be used widely and effectively generally for software- and hardware-related techniques relating to, for example, provision and execution of games and for activities such as designing, manufacture, and sale of such games.

DESCRIPTION OF REFERENCE NUMBERS

1 touch panel
2 display panel
100 dice lottery apparatus
110, 110*a*-110*c* dice blowers
111 pipe
112 blowing mechanism
114 dice table
120 pip-count detector
121 image sensor
130 dice leaning prevention device
131 vibrating device
150 control unit
160 sound control unit
170 communication control unit
200, 200N station machines
210 station control unit
211 CPU
212 ROM
213 RAM
214 communication control unit
250 display device
251 image processing unit
270 musical sound processing unit
271 speaker
280 operation button group
281 call button
282 pay-out button
283 display switching button
290 setting key group
291 audit key
292 reset key
293 bill identification machine
294 printer
300 master machine
310 main control unit
311 CPU
312 ROM
313 RAM
320 communication control unit
321 communication interface
330 master display device
331 monitor
340 timer
350 bus
400 network
1000 dice game system
a1 betting board display area
a2 jackpot bet dividend display area
a3 jackpot meter display area
a4 bet-based switching area
a5 bettable range display area
a6 total bet amount display area
a7 remaining credit amount display area
a8 denomination set value display area
a9 auxiliary display area
a10 remaining bet time display area
a11 history display area
a12 bar graph display area
a13 live display area
b1 jackpot betting button
b2 clear button
b3 undo button
b4 double bet button
b5 history display change button
b6 language switch button
b7 scene switch button
b8 game rule display button
bb betting board
bb1 first betting board
bb2 second betting board
D dice
F frame
LS live screen
m1-m3 hot position display messages
TIP chips

The invention claimed is:

1. A game machine capable of executing a specified game, in which a plurality of players participate, by connecting a corresponding plurality of station machines to enable communications between the station machines via a communication network, each of the station machines including a display panel that displays an image indicating progress of the game including an operation status of a corresponding player; and each station machine being configured to:

generate a first display image including the operation status of the corresponding player;

generate a second display image including the operation status of the corresponding player and an operation status of other players simultaneously participating in the game, the other players associated with other station machines; and switch, in response to a toggling movement, between a first display mode to display the first display image on the display panel and a second display mode to display the second display image on the display panel, wherein the first display image and the second display image are alternatively displayed in a same area of the display panel, and wherein a change made to the operation status of the player included in the first display image causes a corresponding change to be made to the operation status of the player included in the second display image.

2. A game machine comprising:

a plurality of station machines; and a master machine connected to the plurality of station machines to enable communications between the station machines via a communication network, each of the station machines including:

a touch panel that accepts operation by a player;

a display panel that displays an image indicating progress of a game including an operation status of the player corresponding to the operation over the touch panel; and a control unit that transmits the operation status of the player to the master machine and controls display on the display panel;

the master machine integrating the operation status of each respective player at each station machine to form an integrated operation status and transmitting the integrated operation status to each station machine; and each station machine being configured to:

generate a first display image including the operation status of the corresponding player;

generate a second display image including the operation status of the corresponding player and an operation status of other players associated with other station machines by referring to the transmitted integrated operation status, the other players simultaneously participating in the game; and switch, in response to a toggling movement, between a first display mode to display the first display image on the display panel and a second display mode to display a synthetic image, the synthetic image of which is obtained by synthesizing the first display image with the second display image, on the display panel, wherein the first display image and the synthetic image are alternatively displayed in a same area of the display panel, and wherein a change made to the operation status of the player included in the first display image causes a corresponding change to be made to the operation status of the player included in the second display image.

3. The game machine according to claim 2, wherein in the second display mode, the station machine accepts operation performed on the touch panel in response to the first display image and/or operation performed on the touch panel in response to the second display image.

4. The game machine according to claim 2, wherein the station machine is equipped with a display switching switch for switching between the first display mode and the second display mode outside the touch panel.

5. A station machine in a game system capable of executing a specified game, in which a plurality of players participate, by connecting a corresponding plurality of the station machines to enable communications between the station machines via a communication network, the station machine including:

a touch panel that accepts operation by a player;

a display panel that displays an image indicating progress of the game including an operation status of the player corresponding to the operation over the touch panel; and a control unit that controls display on the display panel; and the station machine being configured to enable the control unit to execute:

a function that accepts operation performed on the touch panel;

a function that generates a first display image including the operation status of the corresponding player based on the operation performed on the touch panel;

a function that generates a second display image including the operation status of the corresponding player and an operation status of other players associated with other station machines, the other players simultaneously participating in the game;

a function that displays the first display image on the display panel in response to first operation of a display switching switch, wherein the first operation is a toggling operation; and a function that displays, on the display panel, an image obtained by synthesizing the first display image with the second display image in response to second operation of the display switching switch, wherein the second operation is a toggling operation, wherein the first display image and the image obtained by synthesizing the first display image with the second display image are alternatively displayed in a same area of the display panel, and wherein a change made to the operation status of the player included in the first display image causes a corresponding change to be made to the operation status of the player included in the second display image.

* * * * *